US009869096B2

(12) United States Patent
Brochu

(10) Patent No.: US 9,869,096 B2
(45) Date of Patent: Jan. 16, 2018

(54) MODULAR SURFACE COVERING ASSEMBLY TO COVER A BEARING SURFACE

(71) Applicant: Stéphane Brochu, Saint-Romuald (CA)

(72) Inventor: Stéphane Brochu, Saint-Romuald (CA)

( * ) Notice: Subject to any disclaimer, the term of this patent is extended or adjusted under 35 U.S.C. 154(b) by 0 days.

(21) Appl. No.: 15/486,020

(22) Filed: Apr. 12, 2017

(65) Prior Publication Data

US 2017/0298635 A1 Oct. 19, 2017

Related U.S. Application Data

(60) Provisional application No. 62/321,805, filed on Apr. 13, 2016.

(51) Int. Cl.

| | |
|---|---|
| ***E04F 13/08*** | (2006.01) |
| ***E04F 13/076*** | (2006.01) |
| *E04F 13/12* | (2006.01) |
| *E04F 13/18* | (2006.01) |

(52) U.S. Cl.

CPC ..... *E04F 13/0803* (2013.01); *E04F 13/076* (2013.01); *E04F 13/0894* (2013.01); *E04F 13/12* (2013.01); *E04F 13/18* (2013.01)

(58) Field of Classification Search

CPC . E04F 13/0803; E04F 13/076; E04F 13/0894; E04F 13/18; E04F 13/12

See application file for complete search history.

(56) References Cited

U.S. PATENT DOCUMENTS

| | | | | |
|---|---|---|---|---|
| 2,620,906 A | | 12/1952 | Ketchum, Jr. | |
| 2,736,405 A | * | 2/1956 | Hovey | E04F 13/12 52/584.1 |
| 3,438,168 A | | 4/1969 | Tischuk | |
| 3,564,800 A | | 2/1971 | Armitage | |
| 3,745,736 A | * | 7/1973 | Fischer | A63H 33/062 29/453 |
| 4,283,897 A | | 8/1981 | Thompson | |
| 4,713,918 A | | 12/1987 | Cioffi | |
| 5,388,381 A | * | 2/1995 | Bilinski | E04D 1/20 52/519 |

(Continued)

FOREIGN PATENT DOCUMENTS

| | | | | |
|---|---|---|---|---|
| DE | 2729253 B1 | * | 10/1978 | E01D 19/083 |
| DE | 201 06 147 U | | 7/2001 | |

(Continued)

*Primary Examiner* — Rodney Mintz

(74) *Attorney, Agent, or Firm* — Merchant & Gould P.C.

(57) ABSTRACT

A panel assembly covers a bearing surface. The panel assembly includes a panel and a plurality of panel supports. Each one of the panel supports includes a mounting plate, first and second panel edge engaging portions and a protruding rib engaging portion. The panel includes a first edge region, an opposed second edge region, a covering portion extending between the first and second edge regions, and at least one rearwardly protruding rib extending between the first and second edge regions. The first edge region, the second edge region, and the at least one rearwardly protruding rib of the panel are respectively engageable with the first panel edge engaging portions, the second panel edge engaging portions, and the protruding rib engaging portions of the supports. The panel assembly is translatable with respect to the panel supports when engaged together.

25 Claims, 13 Drawing Sheets

(56) References Cited

U.S. PATENT DOCUMENTS

| | | | | |
|---|---|---|---|---|
| 5,974,742 | A | 11/1999 | Schreiner et al. | |
| 6,216,410 | B1 | 4/2001 | Haberman | |
| 6,314,698 | B1 | 11/2001 | Johansson | |
| 6,718,717 | B2 | 4/2004 | Henderson et al. | |
| 7,900,414 | B2 | 3/2011 | Seccombe | |
| 8,707,648 | B2 | 4/2014 | Timko et al. | |
| 9,309,677 | B1 * | 4/2016 | Anic | E04F 13/0814 |
| 9,593,490 | B2 * | 3/2017 | Anic | E04F 13/0814 |
| 2012/0213974 | A1 * | 8/2012 | Olvey | E04C 2/292<br>428/167 |
| 2014/0013563 | A1 * | 1/2014 | Richardson | E04F 13/0803<br>29/402.09 |
| 2016/0340909 | A1 * | 11/2016 | Riebel | E04F 13/0862 |
| 2017/0044774 | A1 * | 2/2017 | Anic | E04F 13/0814 |

FOREIGN PATENT DOCUMENTS

| | | | |
|---|---|---|---|
| EP | 2 251 500 | A1 | 11/2010 |
| GB | 2 307 924 | | 9/1999 |
| WO | 2009/150174 | A2 | 12/2009 |

* cited by examiner

MODULAR SURFACE COVERING ASSEMBLY TO COVER A BEARING SURFACE

CROSS-REFERENCE TO RELATED APPLICATIONS

This application claims priority under 35USC§119(e) of U.S. provisional patent application No. 62/321,805 filed on Apr. 13, 2016, the specification of which is hereby incorporated by reference.

TECHNICAL FIELD OF THE INVENTION

The technical field generally relates to a modular surface covering assembly to cover a bearing surface, such as a wall or a fence. More specifically, the technical field relates to a modular surface covering assembly comprising a plurality of panels and supports engageable to cover a bearing surface.

BACKGROUND

Modular wall assembly systems are systems useful to cover bearing surfaces, for instance interior walls, exterior walls, fences, soffits etc. Such systems often consist of large plastic or metallic panels, which are nailed in place or otherwise rigidly fixed to a bearing structure, such as a wall, to be covered.

However, once such large panels are rigidly fixed to the bearing structure having a bearing surface to be covered, they tend to buckle and/or curve under their own weight, which can create a space between the panel and the bearing surface against which it is fixed. This space is not desirable, since the bearing surface is therefore no longer adequately protected. The fact that panels tend to buckle and/or curve under their own weight also restrict their height and hence, a larger number of panels may be required to cover a large surface area which can, for instance, result in a longer installation time and higher costs. Moreover, since the panels are rigidly fixed to the bearing structure, thermal expansion due to temperature changes can damage the panels and/or cause them to tear apart.

In view of the above, there is a need for improved modular wall assembly systems to overcome at least some of the drawbacks mentioned above.

BRIEF SUMMARY OF THE INVENTION

It is therefore an aim of the present invention to address the above mentioned issues.

In accordance with a first aspect, there is provided a panel assembly to cover a bearing surface. The panel assembly comprises: a plurality of panel supports and a panel. Each one of the panel supports comprises: a mounting plate with a front face and an opposed bearing surface abutting face; a first panel edge engaging portion; a second panel edge engaging portion; and a protruding rib engaging portion protruding forwardly from the mounting plate between the first and the second panel edge engaging portions. The panel has a front face, an opposed rear face, a first edge region, an opposed second edge region, a covering portion extending between the first and second edge regions, and at least one rearwardly protruding rib extending rearwardly from the rear face, between the first and second edge regions. The panel is engaged with the plurality of panel supports with the rear face of the panel facing the front faces of the mounting plates and the first edge region, the second edge region, and the at least one rearwardly protruding rib being respectively engaged with the first panel edge engaging portions, the second panel edge engaging portions, and the protruding rib engaging portions. When engaged together, the panel is translatable with respect to the panel supports.

In accordance with another aspect, there is provided a modular surface covering assembly to cover a bearing surface, the modular surface covering assembly comprising a plurality of the panel assembly described as described herein.

In accordance with still another aspect, there is provided a panel assembly to cover a bearing surface. The panel assembly comprises a plurality of panel supports and a panel. Each one of the panel supports comprises: a mounting plate with a front face and an opposed bearing surface abutting face; a first panel edge engaging portion; and a second panel edge engaging portion. The panel has a length, a front face, an opposed rear face, a first edge region with a first retaining portion extending longitudinally along the panel, an opposed second edge region with a second retaining portion extending longitudinally along the panel, and a covering portion extending between the first edge region and the second edge region, the first edge region further comprising a first interlocking portion, the first interlocking portion being one of a male member protruding outwardly and a female member defined inwardly, the first interlocking portion being located forwardly of the first retaining portion. The panel is engageable with the plurality of panel supports. When engaged together, the plurality of panel supports are spaced-apart from one another along the length of the panel, the rear face of the panel facing the front faces of the mounting plates, and the first and the second retaining portions are respectively engaged with the first and second panel edge engaging portions of the plurality of panel supports. The panel assembly further comprises a second interlocking portion. The second interlocking portion is the other one of the male member and the female member at an end corresponding to the second edge region of the panel. The first and second interlocking portions of adjacent panel assemblies are engageable into one another with the mounting plate extending outwardly past at least one of the first and second edge regions of the panel, and the panel being translatable with respect to the plurality of panel supports.

In an embodiment, at least one of the first panel edge engaging portion and the second panel edge engaging portion comprises a retention protrusion.

In accordance with a further aspect, there is provided a modular surface covering assembly to cover a bearing surface. The modular surface covering assembly comprises a plurality of panel assemblies. Each one of the panel assemblies comprises a plurality of supports and a panel. Each support comprises a mounting plate with a front face and an opposed bearing surface abutting face, a first panel edge engaging portion and a second panel edge engaging portion, the first and second panel edge engaging portions extending forwardly of the mounting plate. The panel has a first edge region with a first interlocking portion and a first retaining portion extending rearwardly from the first interlocking portion, an opposed second edge region a second retaining portion, and a covering portion extending between the first and second edge regions. One of the second panel edge engaging portion and the second edge region comprises a second interlocking portion engageable in the first interlocking portion of an adjacent one of the plurality of panel assemblies to engage the adjacent panel assemblies together. One of the first and the second interlocking portions comprises an elongated receiving groove and the other one of the first and the second interlocking portions comprises an elongated insertable flange engageable in the elongated receiving groove. The first panel edge engaging portion is engageable with the first retaining portion and the second panel edge engaging portion is engageable with the second retaining portion to maintain the panel engaged with the plurality of supports with the covering portion of the panel being spaced-apart from the mounting plate of the supports when engaged together.

In an embodiment, the adjacent one of the plurality of panel assemblies is a vertically adjacent one.

In an embodiment, the first panel edge engaging portion comprises a first hook and the second panel edge engaging portion comprises a second hook.

In an embodiment, the second edge region comprises the second interlocking portion and the second interlocking portion comprises the elongated receiving groove extending inwardly.

In accordance with another aspect, there is provided a method to cover a bearing surface with a plurality of the panel assembly as described herein. The method comprises the steps of: engaging each one of the panels with a respective one of the plurality of supports by engaging the first and second retaining portions of the panels respectively with the first and second panel edge engaging portions of the respective one of the plurality of supports, the respective one of the plurality of supports being configured in a spaced-apart configuration to obtain the plurality of assembled panel assemblies; securing a first one of the assembled panel assemblies to the bearing surface; positioning a second one of the assembled panel assemblies in an adjacent configuration by engaging one of the first and the second interlocking portions of the first one of the assembled panel assemblies with the other one of the first and the second interlocking portions of the second one of the assembled panel assemblies; and securing the second one of the assembled panel assemblies to the bearing surface.

In accordance with still another aspect, there is provided a panel assembly to cover a bearing surface. The panel assembly comprises a plurality of panel supports, each one of the panel supports comprising: a mounting plate with a front face and an opposed bearing surface abutting face; a first panel edge engaging portion; a second panel edge engaging portion; and a protruding rib engaging portion protruding forwardly from the mounting plate between the first and the second panel edge engaging portions. The panel assembly comprises a panel having a longitudinal axis, a front face, a rear face, a first edge region, a second edge region, opposed to the first edge region, a covering portion extending between the first and second edge regions, and at least one rearwardly protruding rib extending rearwardly from the rear face, in the covering portion between the first and second edge regions. The panel is engaged with the plurality of panel supports with the rear face of the panel facing the front faces of the mounting plates, and the first edge region, the second edge region, and the at least one rearwardly protruding rib being respectively engaged with the first panel edge engaging portions, the second panel edge engaging portions, and the protruding rib engaging portions of the plurality of panel supports. The panel is translatable with respect to the panel supports when engaged together.

In an embodiment, the first panel edge engaging portion comprises a first inwardly extending flange defining a hook opened longitudinally and inwardly to allow translation of the panel along the longitudinal axis when the panel is engaged with the plurality of panel supports.

In an embodiment, the first panel engaging portion further comprises an outwardly extending tab extending away from the bearing surface when a respective one of the panel supports is mounted to the bearing surface and the first inwardly extending flange is superposed forwardly to the outwardly extending tab and defines the hook therewith.

In an embodiment, the hook comprises at least one retention protrusion protruding outwardly of the hook.

In an embodiment, the outwardly extending tab comprises a fastener opening extending therethrough and configured to receive a fastener therein.

In an embodiment, the hook defined in the first panel edge engaging portion is one of a V-shaped hook and a U-shaped hook defined by the first inwardly extending flange, the outwardly extending tab, and a fold provided inbetween.

In an embodiment, the first edge region is inserted into the hook when the panel is engaged with a respective one of the plurality of panel supports.

In an embodiment, the second panel edge engaging portion comprises a second inwardly extending flange defining a receiving recess and a fastening strip, the receiving recess being opened longitudinally to allow translation of the panel along the longitudinal axis when the panel is engaged with the plurality of panel supports.

In an embodiment, the second inwardly extending flange is superposed forwardly to the mounting plate with the receiving recess being defined inbetween.

In an embodiment, the second panel edge engaging portion comprises a fastening strip bight with the fastener strip extending inwardly from the fastening strip bight, the fastener strip being juxtaposed to the mounting plate and comprising a fastener hole extending therethrough and the second inwardly extending flange extending inwardly from the fastener strip.

In an embodiment, the second inwardly extending flange comprises at least one retention protrusion protruding rearwardly therefrom and into the receiving recess.

In an embodiment, the protruding rib engaging portion comprises two engaging jaws extending forwardly from the mounting plate and being spaced-apart to define an insertion channel thereinbetween with a narrower entrance section, wherein the insertion channel is opened longitudinally to allow translation of the panel along the longitudinal axis when a respective one of the at least one rearwardly protruding rib of the panel is engaged into the protruding rib engaging portion.

In an embodiment, the two engaging jaws end with a pair of outwardly protruding flanges configured to guide the at least one rearwardly protruding rib of the panel into the insertion channel and past the narrower entrance section.

In an embodiment, the first edge region of the panel extends longitudinally along the panel and comprises a first retaining portion protruding outwardly.

In an embodiment, the first edge region of the panel extends longitudinally along the panel and comprises a first retaining portion comprising a first abutting flange extending inwardly and ending with a first abutting flange bight extending forwardly and being located rearwardly of the covering portion of the panel.

In an embodiment, the first edge region further comprises a front first edge section and a rear first edge section and a first interlocking portion including an elongated receiving groove extending between the front first edge section and the rear first edge section and being opened outwardly, the elongated receiving groove being located forwardly from the first retaining portion.

In an embodiment, the second edge region of the panel extends longitudinally along the panel and comprises a second retaining portion including a second abutting flange extending outwardly and rearwardly of the covering portion of the panel.

In an embodiment, the second retaining portion further comprises a second abutting flange bight extending forwardly from the second abutting flange.

In an embodiment, the second edge region further comprises a front second edge section, a rear second edge section, and a second interlocking portion including an elongated insertable flange protruding between the front second edge section and the rear second edge section.

In an embodiment, the second edge region further comprises a front second edge section, a rear second edge section, and a second interlocking portion including an elongated receiving groove extending between the front second edge section and the rear second edge section and being opened outwardly.

In an embodiment, the first panel edge engaging portion comprises at least one retention protrusion protruding rearwardly and the first abutting flange bight is configured to engage the at least one retention protrusion when the first panel edge engaging portion is engaged with the first edge region.

In an embodiment, the first edge region of the panel and the second edge region of the panel respectfully corresponds to a lower edge region of the panel and to an upper edge region of the panel, and the first panel edge engaging portion and the second panel edge engaging portion respectfully corresponds to a lower panel edge engaging portion of a respective one of the plurality of panel supports and to an upper panel edge engaging portion of the respective one of the plurality of panel supports, when the panel assembly is inclined.

According to another aspect, there is provided a modular surface covering assembly to cover a bearing surface, the modular surface covering assembly comprising a plurality of the panel assembly as described herein.

According to another aspect, there is provided a panel assembly to cover a bearing surface. The panel assembly comprises a plurality of panel supports, each one of the panel supports comprising: a mounting plate with a front face and a bearing surface abutting face, opposed to the front face; a first panel edge engaging portion; and a second panel edge engaging portion. The panel assembly comprises a panel having a length extending along a longitudinal axis, a front face, a rear face, a first edge region with a first retaining portion extending longitudinally along the panel, a second edge region with a second retaining portion extending longitudinally along the panel, the second edge region being opposed to the first edge region. The panel has a covering portion extending between the first edge region and the second edge region. The second edge region further comprises a second interlocking portion, the second interlocking portion being one of a male member protruding outwardly and a female member defined inwardly, the second interlocking portion being located forwardly of the second retaining portion. The panel is engageable with the plurality of panel supports. When engaged together, the plurality of panel supports are spaced-apart from one another along the length of the panel, the rear face of the panel facing the front faces of the mounting plates, and the first and the second retaining portions being respectively engaged with the first and second panel edge engaging portions of the plurality of panel supports, one of the first panel edge engaging portion and the first edge region further comprising a first interlocking portion, the first interlocking portion being the other one of the male member and the female member, the first and second interlocking portions of adjacent panel assemblies being engageable into one another, the mounting plate extending outwardly past at least one of the first and second edge regions of the panel, and the panel being translatable with respect to the plurality of panel supports.

In an embodiment, the first panel edge engaging portion comprises the first interlocking portion including a first inwardly extending flange defining a hook opened longitudinally and inwardly, the first retaining portion being insertable into the hook and being translatable along the longitudinal axis when the panel is engaged with the plurality of panel supports.

In an embodiment, the first interlocking portion further comprises an outwardly extending tab extending away from the bearing surface when a respective one of the plurality of panel supports is mounted to the bearing surface and the first inwardly extending flange is superposed forwardly to the outwardly extending tab and defines the hook therewith.

In an embodiment, the hook comprises at least one retention protrusion protruding outwardly of the hook.

In an embodiment, the outwardly extending tab comprises a fastener opening extending therethrough and configured to receive a fastener therein.

In an embodiment, the hook defined in the first panel edge engaging portion is one of a V-shaped hook and a U-shaped hook defined by the first inwardly extending flange, the outwardly extending tab, and a fold provided inbetween.

In an embodiment, the first retaining portion protrudes outwardly, the first retaining portion being inserted into the hook when the panel is engaged with a respective one of the plurality of panel supports.

In an embodiment, the second edge region comprises a front second edge section and a rear second edge section and the second interlocking portion comprises an elongated receiving groove extending between the front second edge section and the rear second edge section, the elongated receiving groove extending inwardly and being opened outwardly, the elongated receiving groove being located forwardly from the second retaining portion.

In an embodiment, the first edge region comprises a front first edge section, a rear first edge section and the first interlocking portion; the first interlocking portion comprising an elongated receiving groove defined between the front first edge section and the rear first edge section, the elongated receiving groove being located forwardly from the first retaining portion.

In an embodiment, the first retaining portion comprises a first abutting flange extending inwardly and ending with a first abutting flange bight extending forwardly.

In an embodiment, the second edge region comprises a front second edge section, a rear second edge section, and the second interlocking portion, the second interlocking portion comprising an elongated insertable flange protruding between the front second edge section and the rear second edge section.

In an embodiment, the second retaining portion comprises a second abutting flange extending outwardly and rearwardly of the covering portion of the panel.

In an embodiment, the second retaining portion further comprises a second abutting flange bight extending forwardly from the second abutting flange.

In an embodiment, the first edge region of the panel and the second edge region of the panel respectfully corresponds to a lower edge region of the panel and to an upper edge region of the panel, and the first panel edge engaging portion and the second panel edge engaging portion respectfully corresponds to a lower panel edge engaging portion of a respective one of the plurality of panel supports and to an upper panel edge engaging portion of the respective one of the plurality of panel supports, when the panel assembly is inclined.

According to still another aspect, there is provided a modular surface covering assembly to cover a bearing surface. The modular surface covering assembly comprises a plurality of panel assemblies, each one of the panel assemblies comprising a plurality of panel supports, each one of the panel supports comprising a mounting plate with a front face and a bearing surface abutting face, opposed to the front face, a first panel edge engaging portion a second panel edge engaging portion. The modular surface covering assembly comprises a panel having a first edge region with a first retaining portion, a second edge region with a second retaining portion and a second interlocking portion extending forwardly from the second retaining portion, and a covering portion extending between the first and second edge regions, the first edge region being opposed to the second edge region. One of the first panel edge engaging portion and the first edge region comprises a first interlocking portion engageable with the second interlocking portion of an adjacent one of the plurality of panel assemblies to engage the adjacent one of the panel assemblies together, one of the first and the second interlocking portions comprising an elongated receiving groove and the other one of the first and the second interlocking portions comprising an elongated insertable flange engageable in the elongated receiving groove. The first panel edge engaging portion is engageable with the first retaining portion and the second panel edge engaging portion is engageable with the second retaining portion to maintain the panel engaged with the plurality of panel supports, the covering portion of the panel being spaced-apart from the mounting plate of the panel supports when engaged together.

In an embodiment, the adjacent one of the plurality of panel assemblies is a vertically adjacent one.

In an embodiment, the first panel edge engaging portion comprises the first interlocking portion including the elongated insertable flange extending inwardly and defining a hook opened longitudinally and inwardly, the first retaining portion being insertable into the hook and being translatable along the longitudinal axis when the panel is engaged with the plurality of panel supports.

In an embodiment, the first interlocking portion further comprises an outwardly extending tab extending away from the bearing surface when a respective one of the plurality of panel supports is mounted to the bearing surface and the first inwardly extending flange is superposed forwardly to the outwardly extending tab and defines the hook therewith.

In an embodiment, the hook comprises at least one retention protrusion protruding outwardly of the hook.

In an embodiment, the outwardly extending tab comprises a fastener opening extending therethrough and configured to receive a fastener therein.

In an embodiment, the hook defined in the first interlocking portion is one of a V-shaped hook and a U-shaped hook defined by the first inwardly extending flange, the outwardly extending tab, and a fold provided therebetween.

In an embodiment, the first retaining portion extends longitudinally along the panel and protrudes outwardly, the first retaining portion being inserted into the hook when the panel is engaged with a respective one of the plurality of panel supports.

In an embodiment, the second edge region comprises a front second edge section and a rear second edge section, and the second interlocking portion including the elongated receiving groove extending between the front second edge section and the rear second edge section, the elongated receiving groove extending inwardly and being opened outwardly, the elongated receiving groove being located forwardly from the second retaining portion and being engageable by the hook of a vertically adjacent one of the plurality of panel assemblies.

In an embodiment, the first edge region of the panel extends longitudinally along the panel and comprises a front first edge section, a rear first edge section, and the first interlocking portion; the first interlocking portion comprising the elongated receiving groove defined between the front first edge section and the rear first edge section, the elongated receiving groove being located forwardly from the first retaining portion.

In an embodiment, the first retaining portion further comprises a first abutting flange extending inwardly and ending with a first abutting flange bight extending forwardly.

In an embodiment, the second edge region comprises a front second edge section, a rear second edge section, and the second interlocking portion, the second interlocking portion comprising the elongated insertable flange protruding between the front second edge section and the rear second edge section, and extending forwardly of the second retaining portion.

In an embodiment, the second edge region extends longitudinally along the panel and comprises a second abutting flange extending outwardly and rearwardly of the covering portion of the panel.

In an embodiment, the second retaining portion further comprises a second abutting flange bight extending forwardly from the second abutting flange.

In an embodiment, the first edge region of the panel and the second edge region of the panel respectfully corresponds to a lower edge region of the panel and to an upper edge region of the panel, and the first panel edge engaging portion and the second panel edge engaging portion respectfully corresponds to a lower panel edge engaging portion of a respective one of the plurality of panel supports and to an upper panel edge engaging portion of the support, when the respective one of the plurality of panel supports assembly is inclined.

According to still another aspect, there is provided a method to cover a bearing surface with a plurality of the panel assembly as described herein. The method comprises the steps of engaging each one of the panels with a respective one of the plurality of panel supports by engaging the first and second retaining portions of the panels respectively with the first and second panel edge engaging portions of the respective one of the plurality of panel supports, the respective one of the plurality of panel supports being configured in a spaced-apart configuration to obtain a plurality of assembled panel assemblies; securing a first one of the assembled panel assemblies to the bearing surface; positioning a second one of the assembled panel assemblies in an adjacent configuration by engaging one of the first and the second interlocking portions of the first one of the assembled panel assemblies with the other one of the first and the second interlocking portions of the second one of the assembled panel assemblies; and securing the second one of the assembled panel assemblies to the bearing surface.

BRIEF DESCRIPTION OF THE DRAWINGS

It will be noted that throughout the appended drawings, like features are identified by like reference numerals.

DETAILED DESCRIPTION

In the following description, there are described various embodiments related to a modular surface covering assembly to cover a bearing surface.

Although the embodiments of the modular surface covering assembly and corresponding parts thereof consist of certain geometrical configurations as explained and illustrated herein, not all of these components and geometries are essential and thus should not be taken in their restrictive sense. It is to be understood, as also apparent to a person skilled in the art, that other suitable components and cooperation thereinbetween, as well as other suitable geometrical configurations, may be used for the modular wall assembly, as will be briefly explained herein and as can be easily inferred herefrom by a person skilled in the art.

Moreover, it will be appreciated that positional descriptions such as "downwardly", "rearwardly", "frontwardly", "upper", "lower" and the like should be taken in the context of the figures only and should not be considered limiting. In particular, with respect to an orientation, the term "inwardly" is intended to mean towards a center of the panel or the panel assembly and the term "outwardly" is intended to mean away from the center of the panel or the panel assembly. The term "forwardly" is intended to mean towards the front of a panel, i.e. away from the bearing surface, and the term "rearwardly" is intended to mean towards the bearing surface. When referring to the length, for instance in the context of a length of a panel, it is to be understood that it refers to a measure along a horizontal axis. When referring to rear and front portions of various described features, the rear is intended to mean towards the bearing surface, and the front is intended to mean exposed or away from the bearing surface when mounted thereto. When referring to lower and upper features, it is intended to mean with respect to the relative position of the given feature when it is mounted to the bearing surface having an inclined orientation.

In general terms, the present disclosure concerns a panel assembly that includes a panel and a plurality of supports. More than one panel assembly can be used to form a modular surface covering assembly. The modular surface covering assembly can be suitable to cover a larger surface than would a single panel assembly. As will be readily understood by one skilled in the art, the panel and the support according to the embodiments presented herein and equivalents thereto may be provided separately or with the panel already assembled to the plurality of supports.

Having discussed the general context of the modular surface covering assembly, optional embodiments will be discussed further hereinbelow. The embodiments according to the following description are given for exemplification purposes only.

Figure 1:
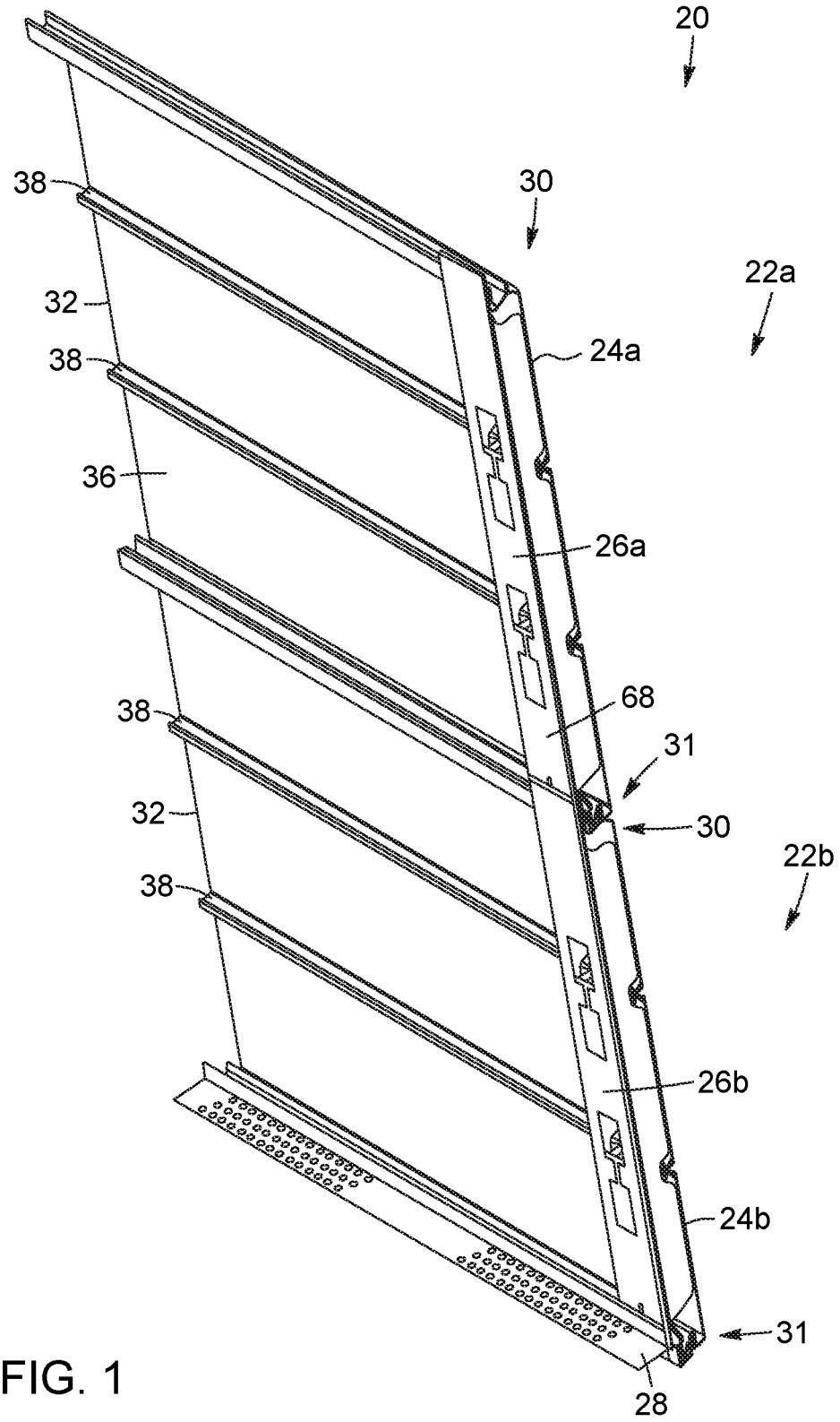
FIG. 1 is a rear perspective view of a modular covering assembly in accordance with an embodiment, wherein the modular covering assembly includes a lower and an upper panel assemblies engaged together.
Figure 2:
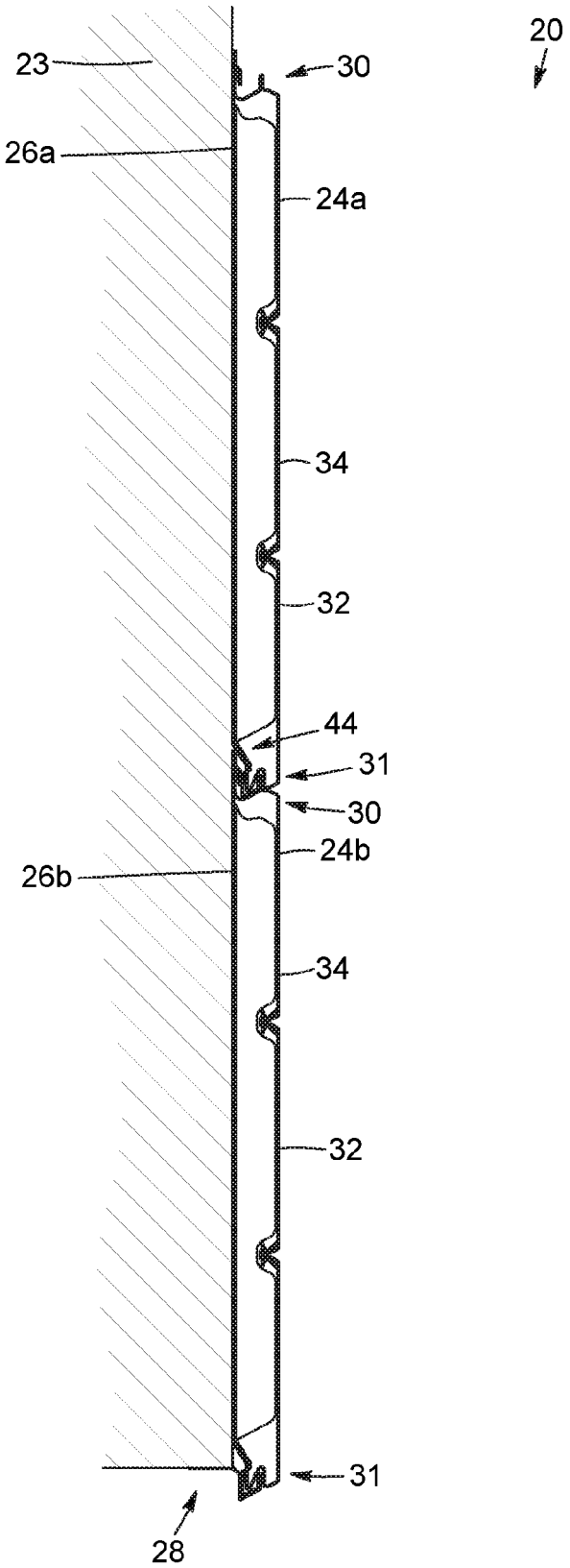
FIG. 2 is a side elevation view of the modular covering assembly shown in FIG. 1.

According to a first aspect, there is provided a modular surface covering assembly. Referring to FIGS. 1 and 2, a modular surface covering assembly 20 according to an embodiment is shown. In this embodiment, the modular surface covering assembly 20 includes two panel assemblies 22 engaged together: an upper panel assembly 22*a* (or second panel assembly) vertically adjacent to a lower panel assembly 22*b* (or first panel assembly). The panel assemblies 22 are engaged to cover a bearing surface (not shown), such as a substantially flat and vertical bearing surface (for instance and without being limitative, a wall or a fence). It is appreciated that, in other implementations, the bearing surface can be horizontally oriented, or inclined. It is to be noted that the inclined orientation includes a vertical orientation of the panel assemblies 22.

Each one of the panel assemblies 22 includes a panel 24 and a plurality of spaced-apart vertically extending supports 26. Each panel 24 is configured to engage with the plurality of supports 26 in a configuration where the supports 26 extend substantially parallel to one another. In the embodiment shown, only one support per panel is shown for illustrative purposes. In an implementation, the modular surface covering assembly 20 shown also includes a starter trim 28, engaged with a lower edge region 31 (or first edge region) of a lowest one of the panel assemblies 22 of the modular surface covering assembly 20. More particularly, in the embodiment shown, the modular surface covering assembly 20 includes two engaged panel assemblies 22*a*, 22*b* and the starter trim 28 is engaged with the lower edge region 31 of the lower panel assembly 22*b*.

In the embodiment shown in FIGS. 1 and 2, the modular covering assembly 20, including the upper and the lower panel assemblies 22*a*, 22*b*, comprises two sets of supports: a set of upper supports 26*a* engaged with the panel 24*a* of the upper panel assembly 22*a* and a set of lower supports 26*b* engaged with the panel 24*b* of the lower panel assembly 22*b*. In the embodiment shown, only one support per set is shown. However, it is appreciated that each set can include a plurality of supports 26, the supports 26 being spaced-apart from one another along the length of the panels 24.

In the description below, the engagement between the panels 24 and the support 26 will be described. It is appreciated that a similar engagement exists between each one of the supports of a set with the respective one of the panels. Thus, in the embodiment shown in FIGS. 1 and 2, the upper panel 24*a* is engaged with the upper support 26*a* while the lower panel 24*b* is engaged with the lower support 26*b*.

As shown in FIG. 2, the engagement of the panels 24*a*, 24*b* with the supports 26*a*, 26*b* defines an air chamber 44 between an outer surface of the bearing surface 23, substantially aligned with a rear face of the supports 26*a*, 26*b*, and the rear face 36 of the panels 24*a*, 24*b*. As will be described in more detail below, the air chamber 44 can have the advantage of providing an improved thermal isolation of the bearing surface 23 and promoting air circulation between the panels 24 and the bearing surface 23.

In the embodiment shown in FIGS. 1 and 2, the upper and the lower panels 24*a*, 24*b* are engaged together and are forming, in combination with their respective supports 26*a*, 26*b*, the modular surface covering assembly 20. In another embodiment, the modular surface covering assembly 20 can be made of any number of panel assemblies 22, depending on the size of the area to be covered and the particularities of the bearing surface 23 to be covered. Since the size of the panel assembly 22 can vary, the number of panel assemblies 22 required to cover a given bearing surface 23 can vary as well. It will be understood that a height of the panels 24 and the length of the panels 24 can also vary, depending on the user's needs.

To simplify the description, only one of the panel assemblies 22 will be described in the following paragraphs. However, it is appreciated that the described features can apply to all panel assemblies 22.

Figure 3:
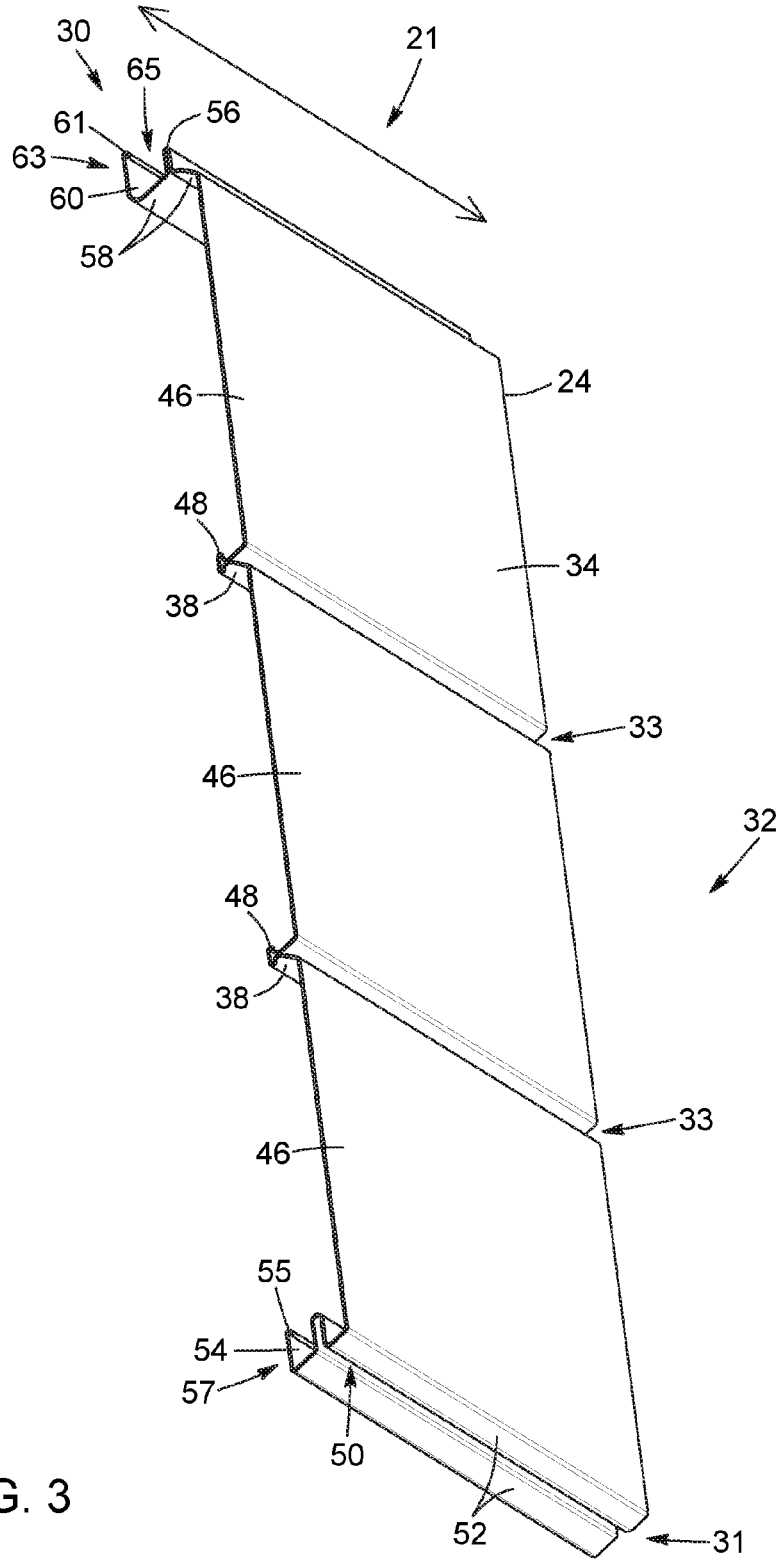
FIG. 3 is a front perspective view of a panel of one of the lower and the upper panel assemblies shown in FIG. 1.
Figure 4:
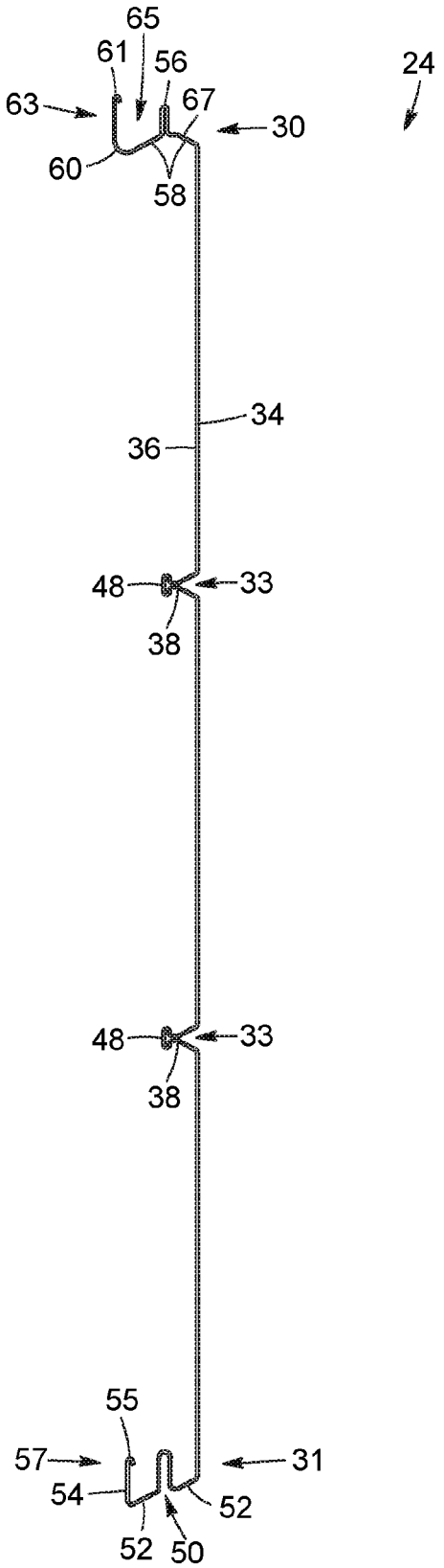
FIG. 4 is a side elevation view of the panel shown in FIG. 3.

Referring now to FIGS. 3 and 4, an embodiment of the panel 24 for the modular surface covering assembly 20 will be described in further detail. More particularly, in the embodiment shown, the panel 24 of each panel assembly 22 has a longitudinal axis 21 and includes an upper edge region 30 (or second edge region) and an opposed lower edge region 31 (or first edge region), each extending along the longitudinal axis 21 of the panel 24, and a covering portion 32 extending thereinbetween. The panel has a front face 34 and an opposed rear face 36, the rear face 36 of the panel 24 facing the bearing surface 23 when the panel 24 is mounted thereto. In an embodiment, the front face 34 of the panel 24, in the covering portion 32, can be substantially flat or include textures or simulated building elements such as elongated planks. In the embodiment shown, the front face 34 of the panel 24, in the covering portion 32, includes simulated elongated planks separated from one another by elongated grooves 33 (see FIG. 3).

In the embodiment shown, each panel 24 further includes two rearwardly protruding ribs 38 that are protruding rearwardly from the rear face 36 of the panel. In the embodiment shown, each one of the protruding ribs 38 extends continuously across the length of the panel 24 (i.e. along a longitudinal axis 21 of the panel 24), between the upper edge region 30 and the lower edge region 31, the purpose of which will be explained in more detail below. It will be understood by the person skilled in the art that the panel 24 can also be exempt of rearwardly protruding ribs 38, or have one or more than two rearwardly protruding rib(s) 38.

Each one of the elongated grooves 33 is aligned with a respective one of the rearwardly protruding ribs 38. More particularly, in the embodiment shown, the elongated grooves 33 and the rearwardly protruding ribs 38 are defined by folds formed in a sheet defining the panel 24. In the embodiment shown, the two rearwardly protruding ribs 38 define three elongated strips 46 of similar dimensions. In the embodiment shown, the rearwardly protruding ribs 38 extend continuously, substantially parallel to one another along the length of the panel 24. In another embodiment (not shown), the rearwardly protruding ribs 38 can be discontinued along the length of panel 24. In the embodiment wherein there is one rearwardly protruding rib 38 per panel 24, the person skilled in the art will understand that the rearwardly protruding rib 38 can be positioned substantially in the middle of the panel 24 such that the elongated strips 46 have substantially similar dimensions.

Each one of the rearwardly protruding ribs 38 includes a bulge 48 at a rear end thereof, the purpose of which will be explained in more detail below. It is appreciated that the shape of the rearwardly protruding rib 38 including the bulge 48 can differ from the shape shown in the Figures.

As will be appreciated by a person skilled in the art, the panels 24 and the supports 26 can be made of various materials, for instance aluminum, steel, plastic or any other rigid material that would be suitable for the embodiments described herein. Moreover, it is to be noted that in the embodiments shown, all the features of the upper and lower edge regions of the panel 24 are formed by folds in a single piece panel.

In the lower edge region 31, the panel 24 defines an elongated receiving groove 50 separating two lower edge sections 52 (or two first edge sections), i.e. a rear one and a front one, and a lower abutting flange 54 (or first abutting flange) extending inwardly from the rear one of the lower edge sections 52, i.e. the one located farthest from the covering portion 32 of the panel 24. The elongated receiving groove 50 extends inwardly towards a center of the panel 24 and is opened in the lower edge region 31, between the two lower edge sections 52. The lower abutting flange 54 ends with an abutting flange bight 55 folded forwardly between the lower abutting flange 54 and the covering portion 32 of the panel 24. An elongated groove of the panel 24, defined by the lower abutting flange 54, the rear one of the edge sections 52 and a rear one of the wall sections defining the elongated receiving groove 50, forms a retaining portion 57 (or first retaining portion) of the lower edge region 31. In the embodiment shown, the retaining portion 57 also includes the bight 55 extending at an end of the lower abutting flange 54.

The upper edge region 30, located at the opposed end of the panel 24 from the lower edge region 31, includes an elongated insertable flange 56, extending outwardly from the center of the panel 24, i.e. away from the center of the panel 24. The elongated insertable flange 56 protrudes between two upper edge sections 58 (or second edge sections), i.e. a rear one and a front one. The upper edge region 30 also includes an upper abutting flange 60 extending outwardly from the rear one of the upper edge sections 58. The upper abutting flange 60 ends with an abutting flange bight 61 folded forwardly between the upper abutting flange 60 and the elongated insertable flange 56. The upper abutting flange 60, optionally in combination with the bight 61, defines a retaining portion 63 (or second retaining portion) of the upper edge region 30.

As will be described in more detail below, the elongated receiving groove 50 is sized and configured to receive the elongated insertable flange 56 of an adjacent panel 24 therein. More specifically, the elongated receiving groove 50 has a width slightly wider than a thickness of the elongated insertable flange 56 to provide a snug fit between the elongated insertable flange 56 and the elongated receiving groove 50 and thus facilitate frictional retention of the two panel assemblies 22*a*, 22*b*. In another embodiment (not shown), it is appreciated that the shape of the elongated receiving groove 50 and the corresponding elongated insertable flange 56 can differ from the shape shown in the Figures.

The combination of the insertable flange 56, a rear one of the upper edge sections 58, i.e. the one located farthest from the covering portion 32 of the panel 24, and the upper abutting flange 60 defines an elongated channel 65. Similarly, the combination of the insertable flange 56 and a front one of the upper edge sections 58, i.e. the one located adjacent to the covering portion 32 of the panel 24, defines an elongated abutting shoulder 67. When two panel assemblies 22 are configured in an adjacent and engaged configuration with the elongated insertable flange 56 of a first one of the panels 24 received in the elongated receiving groove 50 of a second one of the panels 24, a section of the lower abutting flange 54 and the rear one of the lower edge sections 52 of the second panel 24 are received in the elongated channel 65 of the first panel 24 with the rear one of the lower edge sections 52 abutting the rear one of the upper edge sections 58. Similarly, a front one of the lower edge sections 52 of the second panel 24 abuts against the elongated abutting shoulder 67 of the first panel 24.

Figure 5:
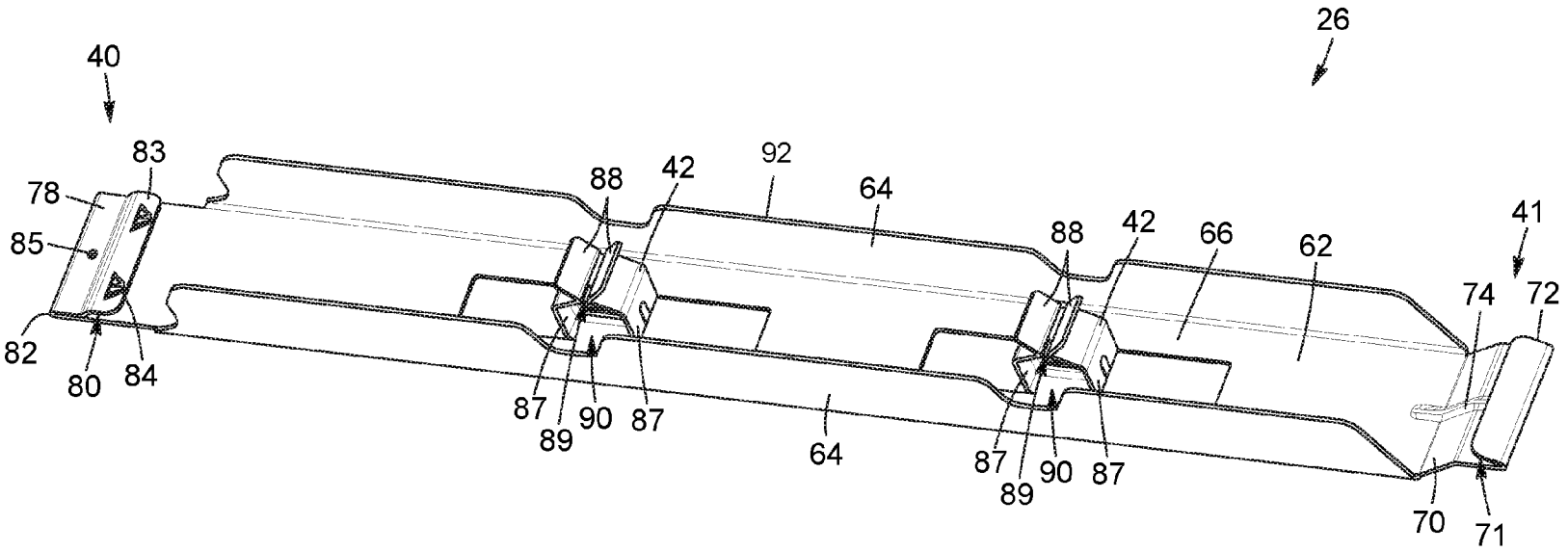
FIG. 5 is a front perspective view of a support of one of the lower and the upper panel assemblies shown in FIG. 1.
Figure 6:
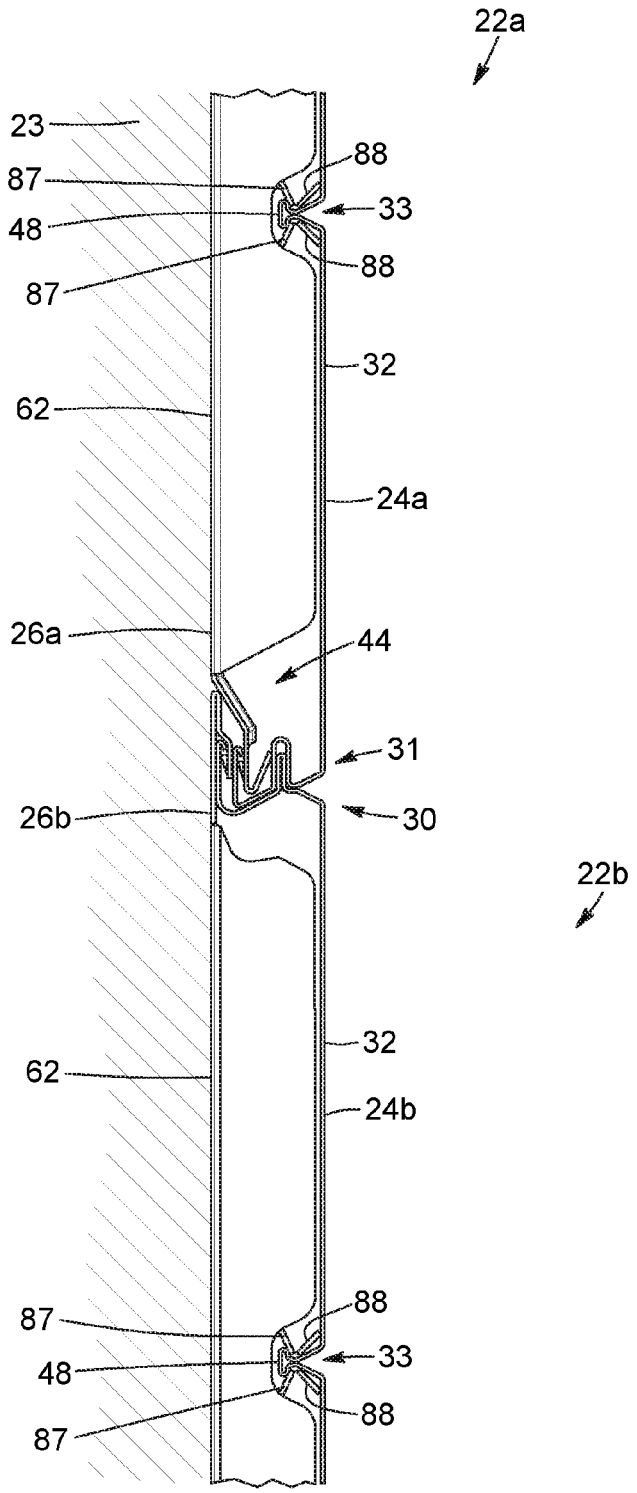
FIG. 6 is a side elevation view, fragmented and enlarged, of the modular covering assembly shown in FIG. 1, showing the engagement of the lower and the upper panel assemblies.

Turning now to FIGS. 5 and 6, an embodiment of the supports 26 of the panel assemblies 22 is shown in more detail. The support 26 shown in FIG. 5 can be used either as the upper support 26*a* or the lower support 26*b*, the two being identical. The support 26 includes a mounting plate 62 and frontwardly extending lateral side walls 64 protruding forwardly from the mounting plate 62, on each side thereof, and extending substantially parallel to one another. The mounting plate 62 has a front face 66 and an opposed bearing surface abutting face 68 to allow the mounting plate 62 to be abutted against the bearing surface 23.

As mentioned above, when engaged with the support 26, the covering portion 32 of the panel 24 is spaced-apart from the mounting plate 62 of the support 26 in a manner such that the air chamber 44 is defined between the bearing surface 23 and the covering portion 32, when the panel 24 is mounted to the support 26. The lateral side walls 64 of the support 26 provide support to the covering portion 32 of the panel 24 if pressure is applied thereon to maintain the covering portion 32 spaced-apart from the bearing surface 23. The lateral side walls 64 of the support 26 also partially close the air chamber 44, preventing access thereto, for instance from substantial water infiltrations or rodents.

The support 26 also includes an upper panel edge engaging portion 40 (or second panel edge engaging portion) and a lower panel edge engaging portion 41 (or first panel edge engaging portion), the mounting plate 62 extending thereinbetween. The upper panel edge engaging portion 40 and the lower panel edge engaging portion 41 are located at an opposed and a respective end of the mounting plate 62. The upper and lower panel edge engaging portions 40, 41 are configured to engage respectively with the upper and the lower edge regions 30, 31 of the panel 24, as will be described in more detail below. The upper and lower panel edge engaging portions 40, 41 extend along a width of the support 26 and opened longitudinally to allow longitudinal translation of the panel 24 with respect to the supports 26, as will be described in more detail below.

The support 26 also includes two protruding rib engaging portions 42 configured to engage with a corresponding one of the rearwardly protruding ribs 38 of the panel 24, as will be described in more detail below. The protruding rib engaging portions 42 protrude forwardly from the mounting plate 62 and are located between the lateral side walls 64 and between the upper panel edge engaging portion 40 and the lower panel edge engaging portion 41. In an embodiment, the number of protruding rib engaging portion(s) 42 of the support 26 corresponds to the number of rearwardly protruding ribs 38 of the engageable panel 24.

In the embodiment shown, a length of the support 26, between the upper and lower panel edge engaging portions 40, 41, is slightly longer than a width of the panel 24, i.e. between the upper and lower edge regions 30, 31, the purpose of which will be explained in further detail hereinbelow.

Still referring to FIG. 5, the lower panel edge engaging portion 41 of the support 26 includes a forwardly and outwardly extending tab 70 extending away from the bearing surface 23, when mounted thereto, and downwardly from the mounting plate 62. In the embodiment shown, the lower panel edge engaging portion 41 also includes an inwardly extending flange 72, extending upwardly from an end of the outwardly extending tab 70, to define a V-shaped hook 71 inbetween. The V-shaped hook is opened longitudinally to allow translation of the panel 24 along the longitudinal axis 21 when the panel 24 is engaged with the support 26, as will be described in more detail below. The outwardly extending tab 70 includes a fastener opening 74 defined therein and configured to receive a fastener (not shown). When the fastener is received in the fastener opening 74, the fastener allows securing the lower panel engaging portion 41 to the bearing surface 23. The fastener can be for instance, without being limitative, a mechanical fastener such as a screw or a nail.

Figure 7:
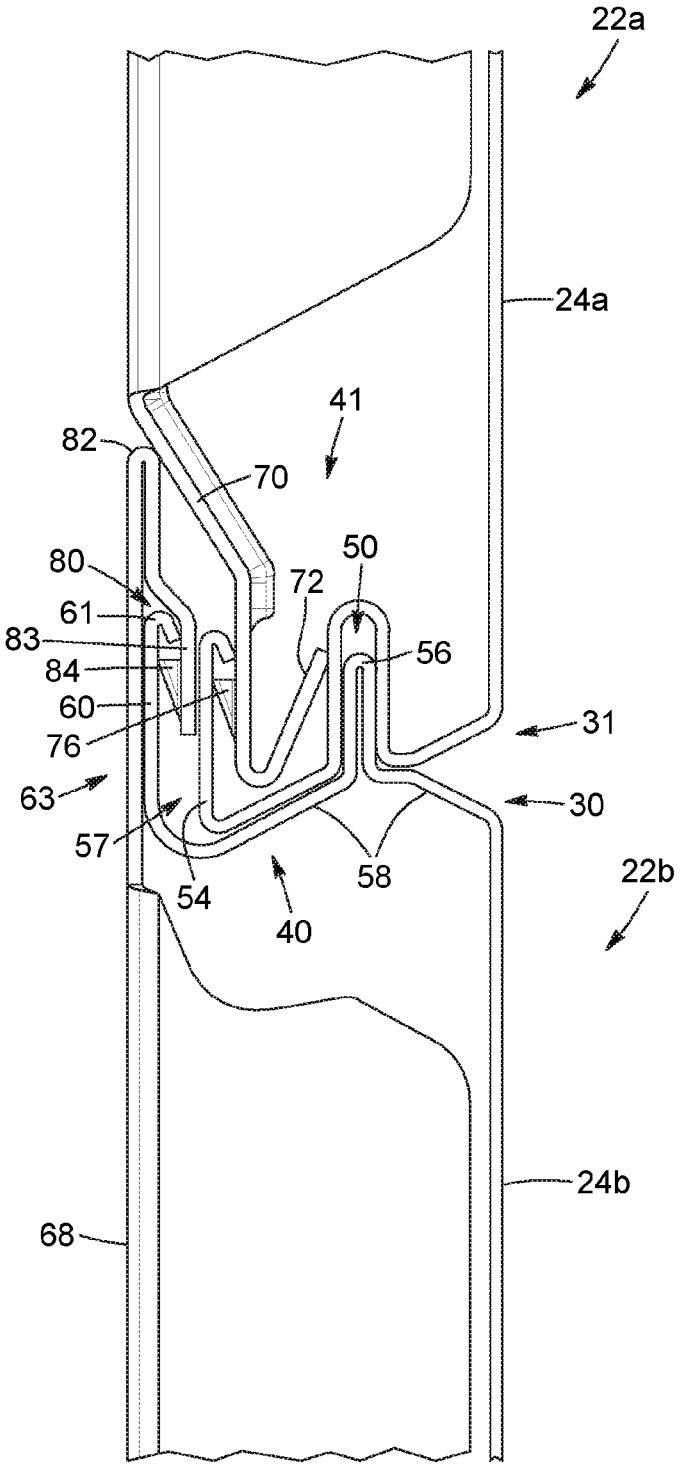
FIG. 7 is another side elevation view, fragmented and enlarged, of the modular covering assembly shown in FIG. 1, showing the engagement of the lower and the upper panel assemblies.
Figure 8:
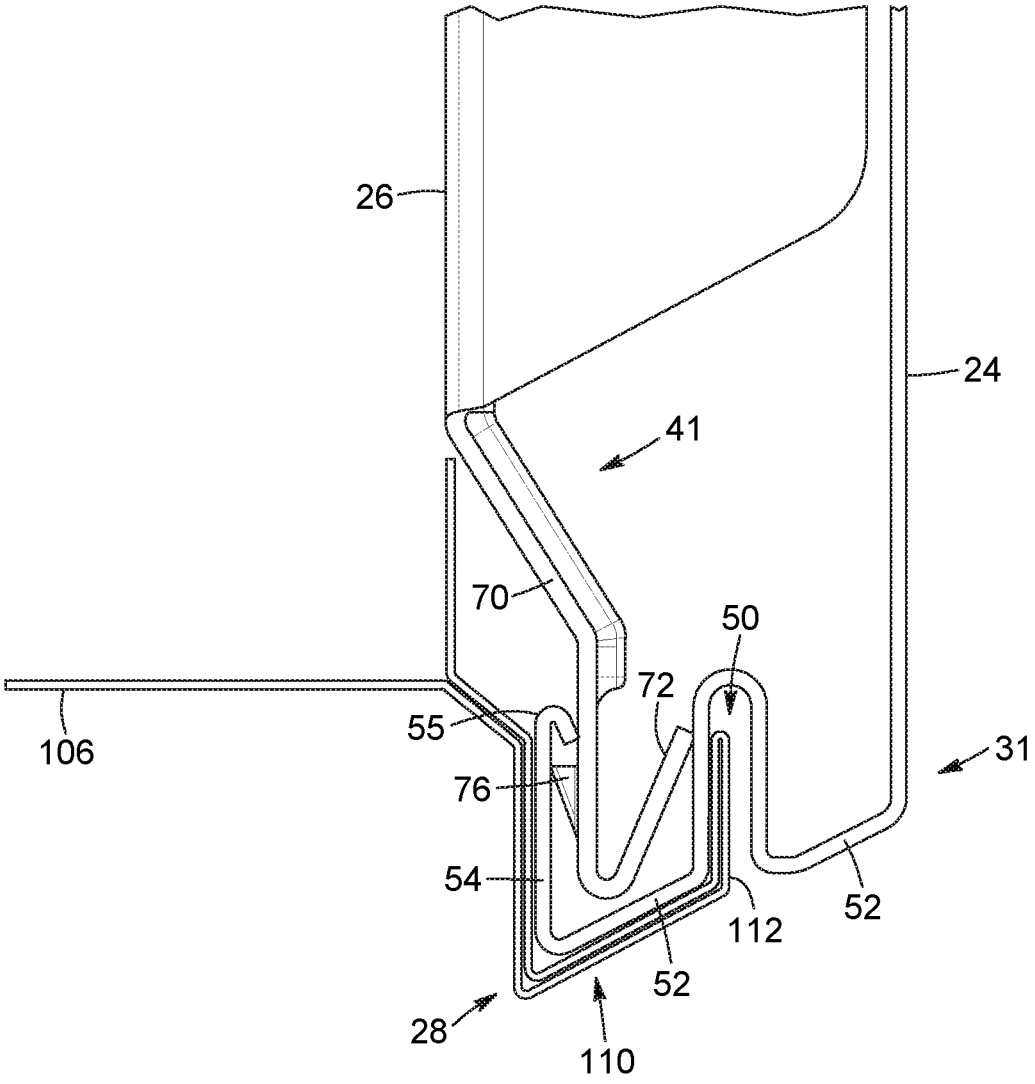
FIG. 8 is a side elevation view, fragmented and enlarged, of the modular covering assembly shown in FIG. 1, showing a lower edge region of the lower panel assembly engaged with a starter trim.

As shown in FIGS. 7 and 8, the lower panel edge engaging portion 41 of the support 26 also includes at least one retention protrusion 76 protruding rearwardly therefrom. In the embodiment shown, the retention protrusion 76 is wedge-shaped with a narrow portion closer to a junction with the inwardly extending flange 72. However, it is appreciated that the shape of the retention protrusion 76 can vary from the embodiment shown.

Referring back to FIG. 5, the upper panel edge engaging portion 40 of the support 26 includes a fastening strip 78 juxtaposed to the mounting plate 62, i.e. superposed thereto. The fastening strip 78 is connected to the mounting plate 62 through a bight 82, ends with a flange 83, and is spaced-apart from the mounting plate 62 to define a hook with an upper receiving recess 80 defined between the flange 83 and the mounting plate 62. The upper receiving recess 80 is opened longitudinally to allow translation of the panel 24 along the longitudinal axis 21 when the panel 24 is engaged with the support 26, as will be described in more detail below. In the embodiment shown, the bight 82 is tightly closed to prevent insertion of the upper abutting flange 60 therein, as will be described in more detail below. In the embodiment shown, each one of the fastening strip 78 and the mounting plate 62 includes a fastener hole 85 to receive a fastener (not shown) with the fastener holes of the fastening strip 78 and the mounting plate 62 being in registry. When the fastener is received in the fastener hole 85 and into the bearing surface 23, the fastener secures the support 26 to the bearing surface 23. As mentioned above, the fastener can be for instance, without being limitative, a mechanical fastener such as a screw or a nail. In some implementations, as will be described in more detail below, the panel assemblies 22 are secured to the bearing surface 23 by inserting mechanical fasteners into the fastener holes 85 of the supports 26, the panel assemblies 22 hanging therefrom.

Figure 9:
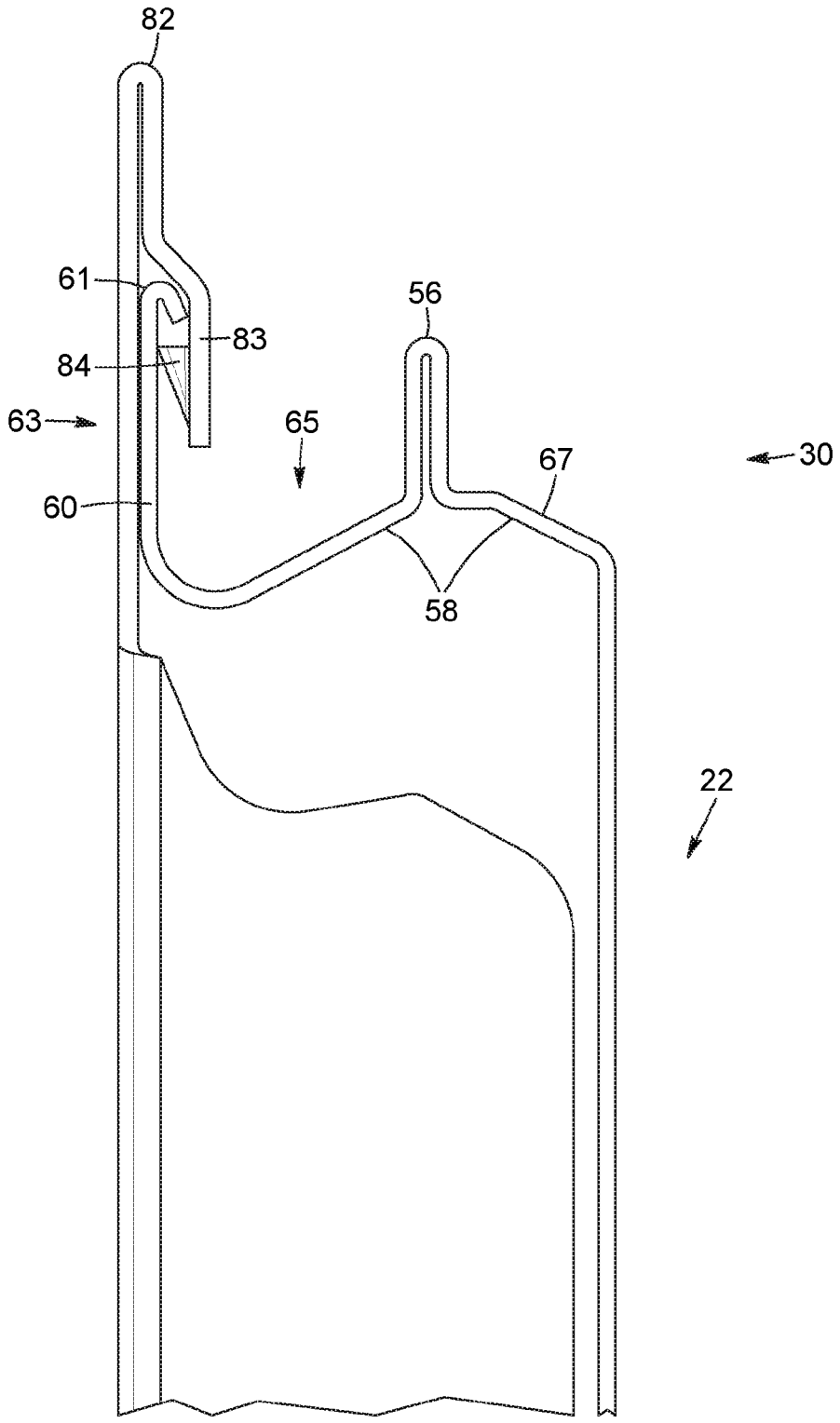
FIG. 9 is a side elevation view, fragmented and enlarged, the modular covering assembly shown in FIG. 1, showing an upper edge region of the upper panel assembly shown in FIG. 1.

As shown in FIGS. 7 and 9, the flange 83 further includes at least one retention protrusion 84 protruding rearwardly from the flange 83 into the upper receiving recess 80, towards the mounting plate 62. In an embodiment, the retention protrusion 84 also has the shape of a wedge, similar to the shape of the retention protrusion 76, with a narrow portion closer to a free edge of the flange 83, i.e. away from the junction with the fastening strip 78. In another embodiment, the shape of the retention protrusion 84 can differ from the embodiment shown.

Referring back to FIG. 5, there is shown that the outwardly extending tab 70 of the lower panel edge engaging portion 41 extends forwardly from the mounting plate 62 and forwardly from the bearing surface 23 when the mounting plate 62 is abutted against the bearing surface 23 to define a spacing between the outwardly extending tab 70 and the bearing surface 23. The spacing is sized to receive therein the fastening strip 78 of the upper panel edge engaging portion 40 of an adjacent support 26, as shown in FIG. 7.

As mentioned above, the mounting plate 62 includes two protruding rib engaging portions 42 protruding forwardly therefrom, towards the rear face 36 of the panel 24 when the panel 24 is mounted to the support 26. In the embodiment shown, each protruding rib engaging portion 42 includes two opposed engaging jaws 87 extending forwardly from the mounting plate 62, the engaging jaws 87 ending with a pair of outwardly protruding flanges 88, i.e. the two flanges 88 of the pair protrude away from one another. The two engaging jaws 87 are spaced-apart to define an insertion channel 90 inbetween with a narrower entrance section 89 adjacent to the outwardly protruding flanges 88. The two outwardly protruding flanges 88 extend in opposed direction. As mentioned above, each one of the protruding rib engaging portions 42 is designed to engage with a respective one of the rearwardly protruding ribs 38 of the panel assembly 22. The outwardly protruding flanges 88 guide the rearwardly protruding rib 38 of the panel 24 towards and into the insertion channel 90, past the narrower entrance section 89. The engaging jaws 87 are resilient allowing insertion of the rearwardly protruding rib 38 of the panel 24 into the insertion channel 90 and engagement of the rearwardly protruding ribs 38 with the protruding rib engaging portions 42 and preventing disengagement therefrom. Thus, by application of a force on the panel including the rearwardly protruding ribs towards the protruding rib engaging portion 42 of the support 26, the bulges 48 of the rearwardly protruding ribs 38 engage with a respective one of the protruding rib engaging portions 42, into the insertion channel 90 and past the narrower entrance section 89, as shown in FIG. 2. Thus, the bulges 48 of the rearwardly protruding ribs 38 are designed to engage with the protruding rib engaging portions 42 of the support 26. In an embodiment, the engagement of the bulge 48 with the protruding rib engaging portion 42 can be unidirectional, i.e. once the bulge 48 is engaged, a substantial amount of force may be required to frontwardly retract the panel 24 from the support 26. In the embodiment shown, the insertion channel 90 is opened longitudinally to allow translation of the panel 24 and more particularly, of the bulges 48 along the longitudinal axis 21 when the panel 24 is engaged with the support 26, as will be described in more detail below.

A panel assembly 22 is thus assembled by engaging a panel 24 with a plurality of spaced-apart supports 26. For engaging the panel 24 with one support 26, the upper retaining portion 63 of the panel 24 is inserted in the upper receiving recess 80 of the upper panel edge engaging portion 40 of the support 26, as shown in FIG. 9. The bight 61 is inserted past the retention protrusion 84 and, once inserted, abuts thereon to prevent disengagement of the panel 24 and the support 26 in the upper edge region 30. In the lower edge region 31, to engage the panel 24 with the support 26, the V-shaped hook 71 defined by the outwardly extending tab 70 and the inwardly extending flange 72, i.e. the panel edge engaging portion, which is substantially resilient, is inserted in the retaining portion 57 of the lower edge region 31. In the embodiment shown, the retaining portion 57 of the lower edge region 31 includes an elongated groove of the panel 24 defined by the lower abutting flange 54, the rear one of the edge sections 52 and a rear one of the wall sections defining the elongated receiving groove 50, as shown in FIG. 8. The retention protrusion 76 is inserted downwardly past the bight 55 of the lower edge region 31. Thus, once inserted, the inwardly extending flange 72 abuts against the rear one of the wall sections defining the elongated receiving groove 50 and the retention protrusion 76 abuts against the bight 55 of the retaining portion 57 of the lower edge region 31 to prevent disengagement of the panel 24 and the support 26 in the lower edge region 31. To further reinforce engagement of the panel 24 with the support, the rearwardly protruding ribs 38 of the panel 24 are engaged with the protruding rib engaging portion 42 of the support 26, as detailed above. Engagement of the panel 24 with the support 26 at least one location between the upper and the lower edge regions 30, 31 prevents or reduces deformation of the covering portion 32 due to the weight of the panel 24, as well as when pressure is applied thereon.

Thus, when the panel 24 is engaged with at least one support 26 to define a panel assembly 22, the upper panel edge engaging portion 40 extends past the upper edge region 30 of the panel 24. More particularly, the fastening strip 78 of the support 26 extends outwardly past the panel 24 in the upper edge region 30. The fastening strip 78 is thus available for securing the panel assembly 22 to the bearing surface 23 when superposed thereto. As mentioned, securing the panel assembly 22 to the bearing surface 23 can be carried out by inserting a mechanical fastener into the fastener hole 85.

Furthermore, the panel 24 is engaged with at least one support 26 by insertion of respective components, i.e. without the components being secured to each other. Thus, the insertion of respective components allows the translation of the panel 24 with respect to the supports 26 along a length of the panel 24. Translation can occur for instance when assembling the panel assembly, or due to thermal expansion and/or contraction. In other words, the panel 24 is engaged with one or more supports 26 but not secured thereto. Furthermore, all engaged components extend along a longitudinal axis 21 of the panel 24, i.e. along its length. Therefore, relative translation of the panel 24 with respect to the support(s) 26 along the longitudinal axis 21 is permitted.

When assembled into a panel assembly 22, the covering portion 32 of the panel 24 is substantially flat and aligned with an outer edge 92 of the frontwardly extending lateral side walls 64 of the support 26. As mentioned above, the lateral side walls 64 of the support 26 provide support to the covering portion 32 of the panel 24 if pressure is applied thereon to maintain the covering portion 32 spaced-apart from the bearing surface 23.

Referring now to FIGS. 6 and 7, engagement of adjacent panel assemblies 22 and mounting of the panel assemblies 22 to a bearing surface will be described. In the embodiment shown, only two panel assemblies 22 are engaged together to define the modular surface covering assembly 20, i.e. the lower and the upper panel assemblies 22*a*, 22*b*. However, as mentioned above, the modular surface covering assembly 20 can include more than two panel assemblies 22.

In an embodiment, assemblage of the panel assemblies 22 is carried out following assemblage of the panel assemblies, i.e. assemblage of the panels 24 with the supports 26.

Two adjacent panel assemblies 22*a*, 22*b* are engaged by engaging the upper edge region 30 of the lower panel 24*b* with the lower edge region 31 of the upper vertically adjacent panel 24*a*. Typically, the lower panel assembly 22*b* is first secured to the bearing surface 23 by inserting mechanical fasteners into the fastener strips 78 of the supports 26. Then, the upper panel assembly 22*a* is positioned above the lower panel assembly 22*b* and lowered until the elongated insertable flange 56 protruding in the upper edge region 30 of the lower panel assembly 22*b* is inserted in the elongated receiving groove 50 of the lower edge region 31 of the upper panel assembly 22*a*. When the flange 56 is received in the groove 50 of the adjacent panel assembly, a section of the lower abutting flange 54 and the rear one of the lower edge sections 52 of the upper panel assembly 22*a* are received in the elongated channel 65 of the lower panel assembly 22*b* with the rear one of the lower edge sections 52 abutting the rear one of the upper edge sections 58. Similarly, a front one of the lower edge sections 52 of the upper panel assembly 22*a* abuts against the elongated abutting shoulder 67 of the lower panel assembly 22*b*.

Following engagement of the two panel assemblies 22*a*, 22*b*, the upper panel 24*a* can be secured to the bearing surface 23 by inserting mechanical fasteners into the fastener strips 78 of the supports 26. The same steps can be carried out sequentially until the bearing surface is covered with panel assemblies 22.

Figure 10:
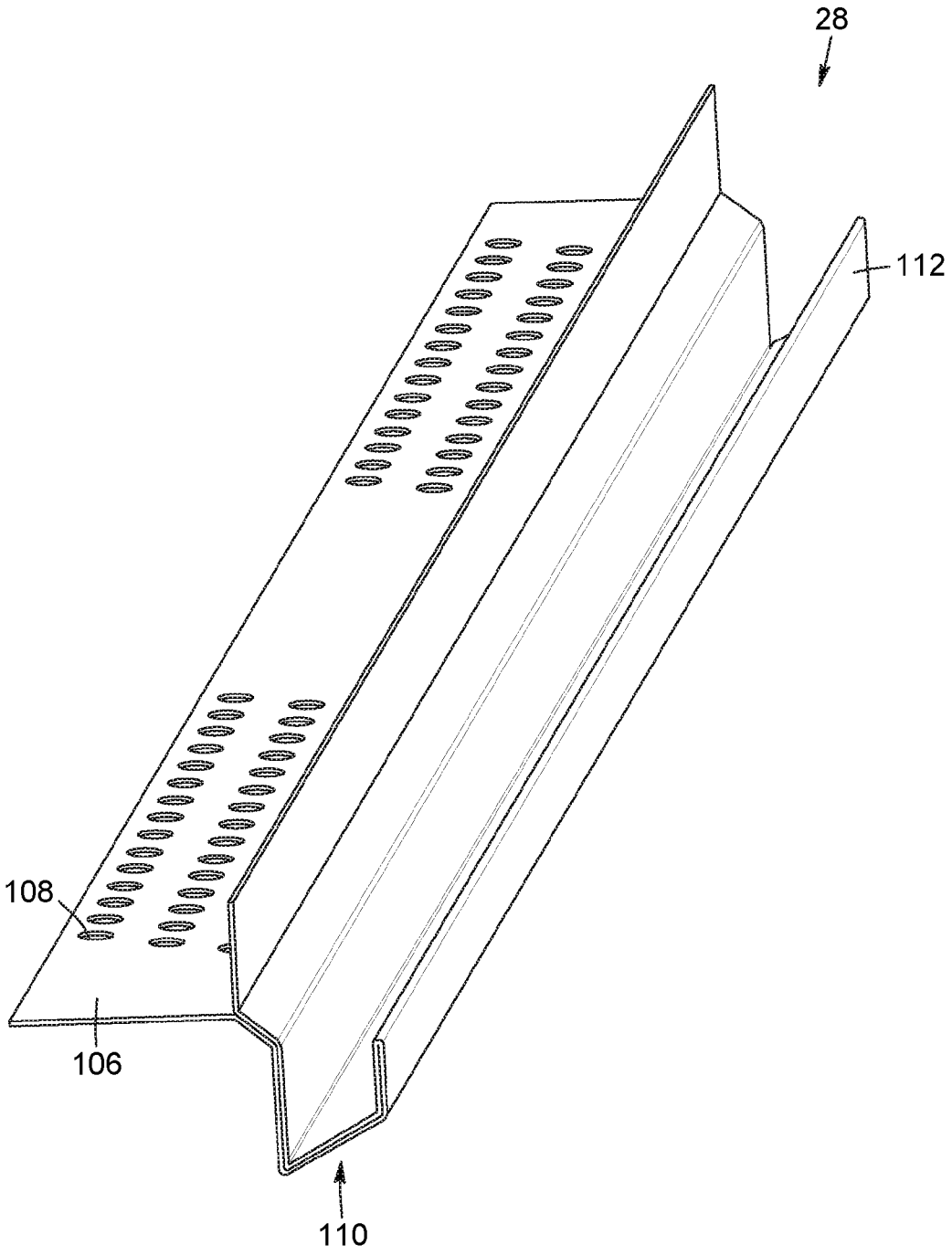
FIG. 10 is a perspective view of the starter trim shown in FIG. 8.

Referring now to FIG. 8, the starter trim 28 is shown engaged with the lower edge region 31 of the lower panel assembly 22*b*. In the embodiment shown in FIG. 10, the starter trim 28 includes a rearwardly extending segment 106 having a plurality of through holes 108, an inwardly extending segment 114 and a hook-shaped engaging portion 110. The inwardly extending segment 114 allows for instance to substantially close off the air chamber 44, in a lower portion thereof, while allowing condensation forming along the bearing surface 23 to be evacuated through the through holes 108. In an embodiment, the starter trim 28 is engaged with the lower panel assembly 22*b* by inserting a leg 112 of the hook-shaped engaging portion 110 into the elongated receiving groove 50 of the lower edge region 31 of the panel 24 of the lower panel assembly 22*b* with the hook-shaped engaging portion 110 surrounding a rear portion of the lower edge region 31 of the panel 24 of the lower panel assembly 22*b*.

When the panel assembly 22 as described herein is secured to the bearing surface 23 with the mechanical fastener going through the fastener hole 85 of the fastening strip 78 of the upper panel edge engaging portion 40 of the support 26, the lower panel 24*b* remains laterally translatable since the panel 24 is not fastened or secured to the bearing surface 23 or the support 26 but solely engaged with the support 26. In a similar manner, when the lower panel edge engaging portion 41 of the support 26 is fastened to the bearing surface 23, the panel 24 still remains movable as it is once again not fastened to the bearing surface 23. Additionally, when the vertically adjacent panel assembly 22 is engaged with the panel assembly 22 already secured to the bearing surface 23, each panel 24 remains movable with respect with their corresponding supports 26 and with respect with one another. Thus, the engagement of each of the panels 24 with their respective support 26 and the engagement of the panel assemblies 22 with one another allow each panel 24 to translate along the rearwardly protruding rib 38, and the upper and lower panel edge engaging portions 40, 41. These engagements may have the advantage of preventing the panels 24 from being damaged or being teared apart when subjected to thermal expansion.

The height of covering panels known in the art is commonly restricted by their tendency to curve under their own weight, which can result in a separation of the panels from a bearing surface, such as a wall surface, to which they are abutted to. With the panel assembly 22 described herein, the engagement of the rearwardly protruding ribs 38 with a corresponding protruding rib engaging portion 42 may prevent the panel 24 from buckling or from being deformed when a panel 24 is considerably high, since the panel 24 is engaged at least once in between the upper and the lower edge regions 30, 31, and advantageously in the middle of the panel 24. This configuration may allow to use higher panels 24 and hence reduce the number of panel assemblies 22 necessary to cover a large surface. Consequently, the time necessary to install the panel assemblies 22 may be reduced. As mentioned above, each panel 24 can also have more than two rearwardly protruding ribs 38, especially with higher panels 24, to stabilize the panel further.

Figure 11:
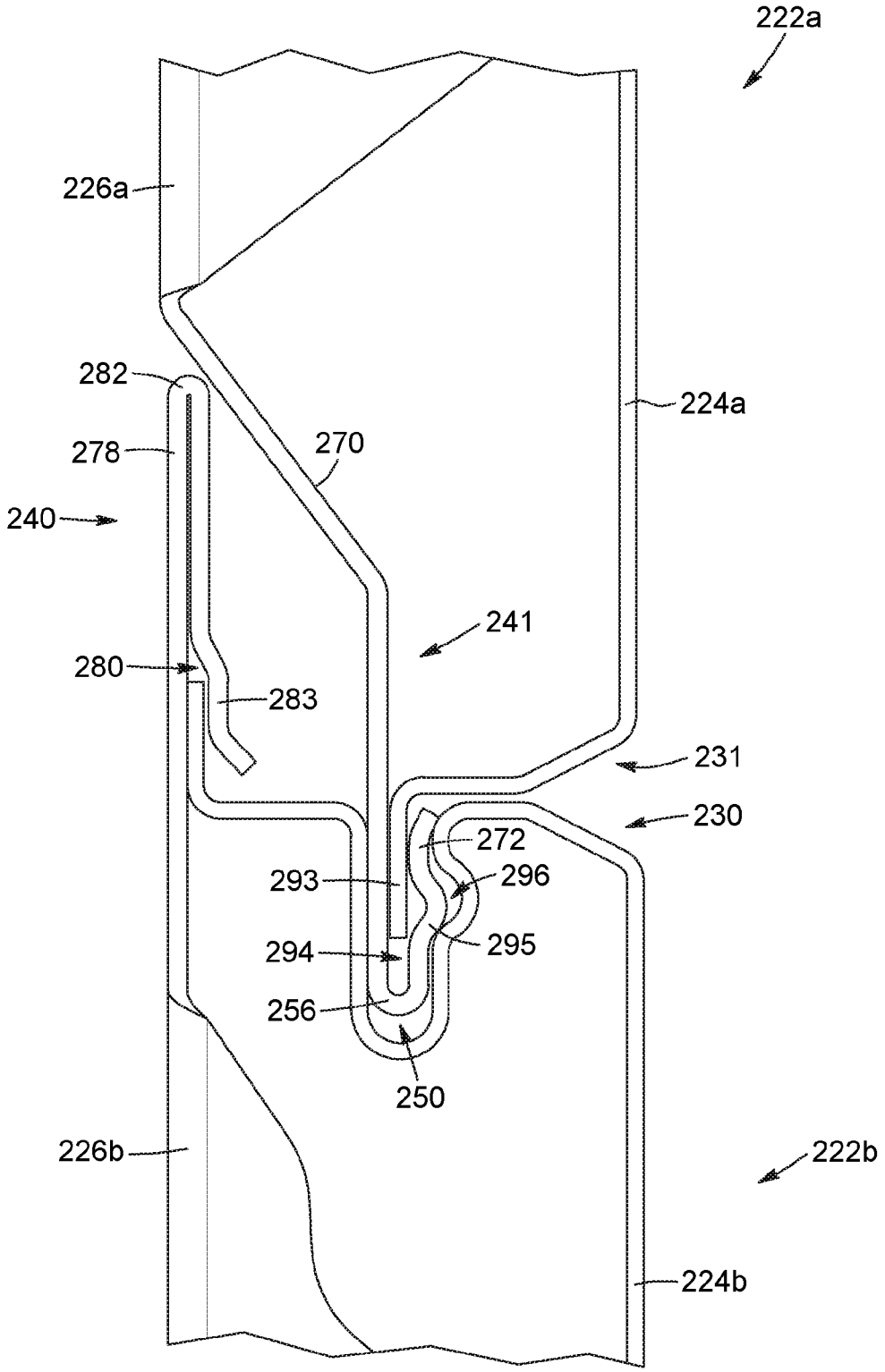
FIG. 11 is a side elevation view, fragmented and enlarged, of a modular covering assembly according to a second embodiment, wherein the modular covering assembly includes a lower and an upper panel assemblies engaged together, and wherein the engagement of the lower and the upper panel assemblies is shown.
Figure 12:
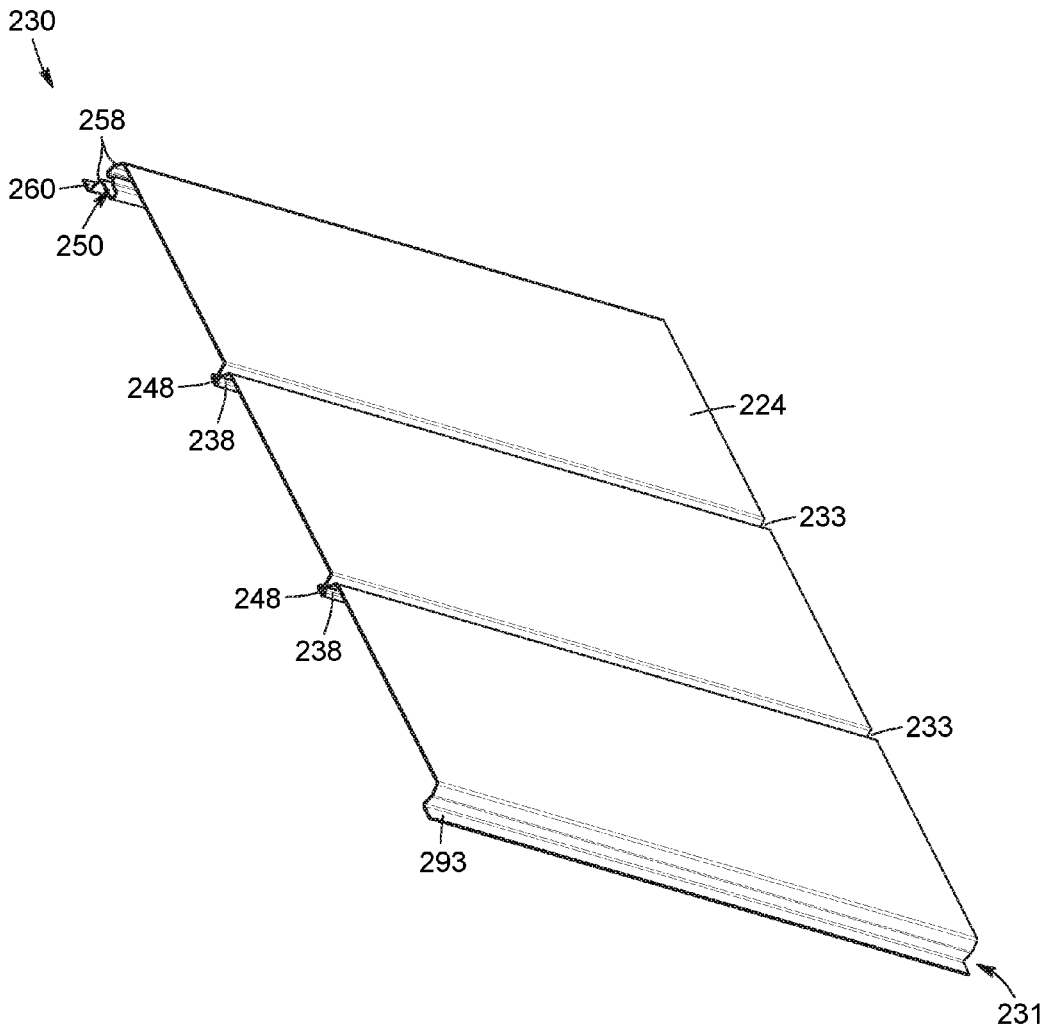
FIG. 12 is a front perspective view of a panel of one of the lower and the upper panel assemblies shown in FIG. 11.
Figure 13:
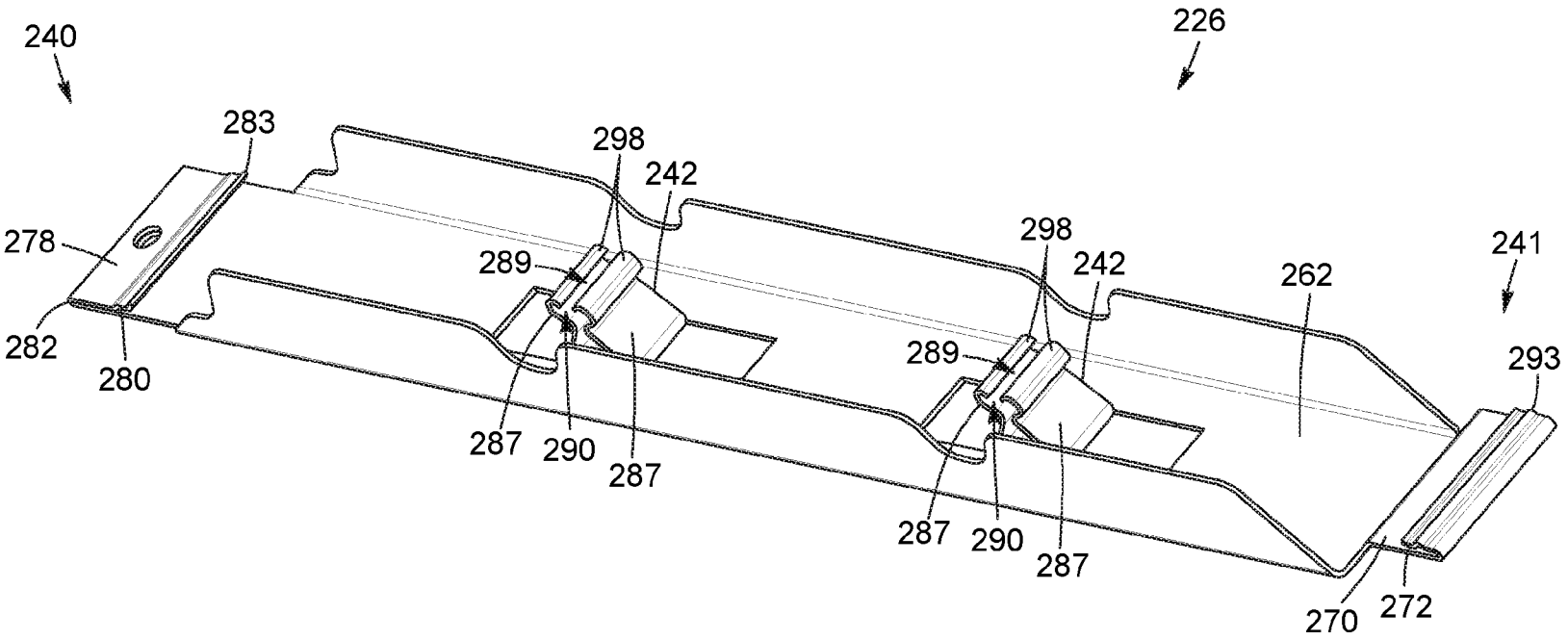
FIG. 13 is a front perspective view of a support of one of the lower and the upper panel assemblies shown in FIG. 11.

Referring to FIGS. 11 to 13, there is shown a second embodiment of a panel assembly 222 wherein the features are numbered with reference numerals in the 200 series, which correspond to the reference numerals of the first embodiment with the following adaptations.

Referring to FIG. 11, the engagement of two adjacent panel assemblies 222*a*, 222*b* according to the second embodiment is shown. Each one of the panel assembly 222*a*, 222*b* shown in FIG. 11 includes a respective panel 224*a*, 224*b* engaged with a respective set of supports 226*a*, 226*b*. However, the panel 224*a*, 224*b* is engaged differently to the set of supports 226*a*, 226*b* compared to the first embodiment. The panel assemblies 222*a*, 222*b* are also engaged with one another differently from the first embodiment.

More particularly, instead of connecting two adjacent panel assemblies by engaging male and female components provided at opposed ends of the panel as shown in the above-described embodiment, the two adjacent panel assemblies are connected by engaging a male member provided in the support into a female member defined in a panel.

In the upper edge region 230, the engagement between the panel 224*a*, 224*b* and the support 226*a*, 226*b* is substantially similar to the embodiment described above in reference to FIGS. 1 to 10 and will not be described in further detail below. Of note, as with the embodiment illustrated in FIGS. 1 to 10, the upper panel edge engaging portion 240 of the support 226*b* includes a fastening strip 278 juxtaposed to the mounting plate through a fastening strip bight 282, the fastening strip 278 ending with a flange 283 to define a hook with an upper receiving recess 280 defined between the flange 283 and the mounting plate of the support 226*b*.

In the lower edge region 231, a lower free edge 293 of the panel 224*a* is inserted into a lower receiving recess 294 defined in the lower panel edge engaging portion 241 of the support 226*a*. More particularly, the lower receiving recess 294 is defined between the outwardly extending tab 270 and an inwardly extending flange 272. In combination, the outwardly extending tab 270 and an inwardly extending flange 272 define a U-shaped hook. As shown in FIG. 11, the inwardly extending flange 272 comprises a forwardly extending protrusion 295, the purpose of which will be defined in more detail below. The combination of the inwardly extending flange 272 and a section of the outwardly extending tab 270 to which the inwardly extending flange 272 is substantially superposed defines the insertable flange 256 of the panel assembly 222*a*.

In the upper edge region 230, an elongated receiving groove 250 is defined in the panel 224*b*. The elongated receiving groove 250 comprises a forwardly extending cavity 296 defined by a protrusion in the front wall section of the panel 224*b* defining the elongated receiving groove 250.

The elongated receiving groove 250 is sized and configured to receive the insertable flange 256 of a vertically-adjacent panel assembly 222*a*. When engaged together, the forwardly extending protrusion 295 is inserted in the forwardly extending cavity 296 to maintain the two panel assemblies 222*a*, 222*b* engaged together, i.e. to substantially prevent disengagement.

Referring now to FIGS. 12 and 13, the protruding rib engaging portions 242 of the support 226 includes the engaging jaws 287 extending forwardly from the mounting plate 262, the engaging jaws defining the insertion channel 290 thereinbetween, similarly to the protruding rib engaging portion 42 of the first embodiment. However, instead of the outwardly protruding flanges 88, each one of the two opposed engaging jaws 287 of the second embodiment ends with a curved flange 298 extending inwardly, towards each other. A narrower entrance section 289 is defined between each end of the pair of curved flanges 298, and is sized to receive a neck of the bulge 248. Thus, when the rearwardly protruding rib 238 of the panel 224 is engaged with the protruding rib engaging portion 242 of the support 226, the neck of the bulge 248 is received in the narrower entrance section 289 and the bulge 248 is received within the insertion channel 290.

As in the first embodiment, the panels 224*a*, 224*b* are engaged with their respective plurality of supports 226*a*, 226*b* to form a respective panel assembly 222*a*, 222*b*, and the panel assemblies 222*a*, 222*b* are engaged together to form the modular surface covering assembly. Once again, these engagements allow the adjacent panels 224*a*, 224*b* to translate with respect to the supports 226, along the rearwardly protruding rib(s) 238, and along the lower and upper panel edge engaging portions 240, 241.

According to a second aspect, there is provided a method for covering bearing surfaces with a plurality of the panel assemblies described herein. The method includes the following steps.

A first panel is engaged to a first plurality of supports, by engaging the lower edge region of the first panel to the lower panel edge region of a respective one of the first plurality of supports, and by engaging the upper edge region of the first panel to the upper panel edge region of the respective one of the first plurality of supports. More specifically, the lower and the upper retaining portions of the first panel are engaged with the lower and the upper retention protrusions, respectively. In an embodiment wherein the first panel includes one or more rearwardly protruding ribs, the first plurality of supports may be chosen to include protruding rib engaging portions. In this embodiment, the engagement of the first panel to the first plurality of supports is further performed by engaging the rearwardly protruding rib(s) with the protruding rib engaging portion(s). This step allows to obtain the first assembled panel assembly. Optionally, the starter trim can be engaged to the lower edge region of one of the panels. In order to do so, the upwardly extending bight of the starter trim is inserted into the elongated receiving groove of the lower edge region of the panel.

Then, a second assembled panel assembly is obtained by engaging a second panel to a second plurality of panels and so on until a given number of assembled panel assemblies is obtained.

Then, the first panel assembly is secured to the bearing surface, by fastening at least the upper panel edge engaging portion of each of the respective one of the first plurality of supports to the bearing surface. In the embodiment wherein the starter trim is used, the trim is first secured to the bearing surface and, then, the lower panel edge engaging portion of a lowest panel is engaged with the trim. It can be appreciated that in another embodiment, the plurality of supports can be fastened to the bearing surface prior to engaging the panel therewith A second panel assembly is then placed in a vertically adjacent configuration with respect to the first panel assembly, by engaging the lower edge region of the adjacent panel with the upper edge region of the panel. More specifically, the elongated receiving groove of one of the adjacent panels is placed such that the elongated insertable flange is inserted therein.

Once the second panel assembly is engaged with the first panel assembly, the second panel assembly is secured to the bearing surface.

Additional panel assemblies can then be secured in series one above each other until the desired height is reached.

It will be appreciated that the method described herein may be performed in the described order, or in any suitable order.

Several alternative embodiments and examples have been described and illustrated herein. The embodiments of the invention described above are intended to be exemplary only. A person of ordinary skill in the art would appreciate the features of the individual embodiments, and the possible combinations and variations of the components. A person of ordinary skill in the art would further appreciate that any of the embodiments could be provided in any combination with the other embodiments disclosed herein. It is understood that the invention may be embodied in other specific forms without departing from the central characteristics thereof. The present examples and embodiments, therefore, are to be considered in all respects as illustrative and not restrictive, and the invention is not to be limited to the details given herein. Accordingly, while the specific embodiments have been illustrated and described, numerous modifications come to mind. The scope of the invention is therefore intended to be limited solely by the scope of the appended claims.

The invention claimed is:

1. A panel assembly to cover a bearing surface, the panel assembly comprising:

a plurality of panel supports, each one of the panel supports comprising:

a mounting plate with a front face and an opposed bearing surface abutting face;

a first panel edge engaging portion;

a second panel edge engaging portion; and a protruding rib engaging portion protruding forwardly from the mounting plate between the first and the second panel edge engaging portions;

a panel having a longitudinal axis, a front face, a rear face, a first edge region, a second edge region, opposed to the first edge region, a covering portion extending between the first and second edge regions, and at least one rearwardly protruding rib extending rearwardly from the rear face, in the covering portion between the first and second edge regions;

the panel being engaged with the plurality of panel supports with the rear face of the panel facing the front faces of the mounting plates and the first edge region, the second edge region, and the at least one rearwardly protruding rib being respectively engaged with the first panel edge engaging portions, the second panel edge engaging portions, and the protruding rib engaging portions of the plurality of panel supports;

wherein the panel is translatable with respect to the panel supports when engaged together.

2. The panel assembly of claim 1, wherein the second panel edge engaging portion comprises a fastening strip bight and a second inwardly extending flange defining a receiving recess and a fastening strip, the fastener strip extending inwardly from the fastening strip bight, being juxtaposed to the mounting plate and comprising a fastener hole extending therethrough, the second inwardly extending flange extending inwardly from the fastener strip and being superposed forwardly to the mounting plate with the receiving recess being defined inbetween, the receiving recess being opened longitudinally to allow translation of the panel along the longitudinal axis when the panel is engaged with the plurality of panel supports and the second inwardly extending flange comprises at least one retention protrusion protruding rearwardly therefrom and into the receiving recess.

3. The panel assembly of claim 1, wherein the protruding rib engaging portion comprises two engaging jaws extending forwardly from the mounting plate and being spaced-apart to define an insertion channel thereinbetween with a narrower entrance section, wherein the insertion channel is opened longitudinally to allow translation of the panel along the longitudinal axis when a respective one of the at least one rearwardly protruding rib of the panel is engaged into the protruding rib engaging portion.

4. The panel assembly of claim 1, wherein the first edge region of the panel extends longitudinally along the panel and comprises a first retaining portion protruding outwardly and the second edge region of the panel extends longitudinally along the panel and comprises a second retaining portion including a second abutting flange extending outwardly and rearwardly of the covering portion of the panel.

5. The panel assembly of claim 1, wherein the first edge region of the panel extends longitudinally along the panel and comprises a first retaining portion comprising a first abutting flange extending inwardly and ending with a first abutting flange bight extending forwardly and being located rearwardly of the covering portion of the panel and the second edge region of the panel extends longitudinally along the panel and comprises a second retaining portion including a second abutting flange extending outwardly and rearwardly of the covering portion of the panel.

6. The panel assembly of claim 1, wherein the first edge region of the panel and the second edge region of the panel respectfully corresponds to a lower edge region of the panel and to an upper edge region of the panel, and the first panel edge engaging portion and the second panel edge engaging portion respectfully corresponds to a lower panel edge engaging portion of a respective one of the plurality of panel supports and to an upper panel edge engaging portion of the respective one of the plurality of panel supports, when the panel assembly is inclined.

7. The panel assembly of claim 1, wherein the first panel edge engaging portion comprises a first inwardly extending flange defining a hook opened longitudinally and inwardly to allow translation of the panel along the longitudinal axis when the panel is engaged with the plurality of panel supports, the hook comprising at least one retention protrusion protruding outwardly of the hook.

8. The panel assembly of claim 7, wherein the first panel engaging portion further comprises an outwardly extending tab extending away from the bearing surface when a respective one of the panel supports is mounted to the bearing surface and the first inwardly extending flange is superposed forwardly to the outwardly extending tab and defines the hook therewith.

9. The panel assembly of claim 7, wherein the first edge region is inserted into the hook when the panel is engaged with a respective one of the plurality of panel supports.

10. A modular surface covering assembly to cover a bearing surface, the modular surface covering assembly comprising:

a plurality of panel assemblies, each one of the panel assemblies comprising:

a plurality of panel supports, each one of the panel supports comprising a mounting plate with a front face and a bearing surface abutting face, opposed to the front face, a first panel edge engaging portion and a second panel edge engaging portion;

a panel having a first edge region with a first retaining portion, a second edge region with a second retaining portion and a second interlocking portion extending forwardly from the second retaining portion, and a covering portion extending between the first and second edge regions, the first edge region being opposed to the second edge region;

one of the first panel edge engaging portion and the first edge region comprising a first interlocking portion engageable with the second interlocking portion of an adjacent one of the plurality of panel assemblies to engage the adjacent one of the panel assemblies together, one of the first and the second interlocking portions comprising an elongated receiving groove and the other one of the first and the second interlocking portions comprising an elongated insertable flange engageable in the elongated receiving groove;

the first panel edge engaging portion being engageable with the first retaining portion and the second panel edge engaging portion being engageable with the second retaining portion to maintain the panel engaged with the plurality of panel supports, the covering portion of the panel being spaced-apart from the mounting plate of the panel supports when engaged together.

11. The modular surface covering assembly of claim 10, wherein the adjacent one of the plurality of panel assemblies is a vertically adjacent one.

12. The modular surface coverin assembly of claim 10, wherein the first edge region of the panel extends longitudinally along the panel and comprises a front first edge section, a rear first edge section, and the first interlocking portion; the first interlocking portion comprising the elongated receiving groove defined between the front first edge section and the rear first edge section, the elongated receiving groove being located forwardly from the first retaining portion and the second edge region comprises a front second edge section, a rear second edge section, and the second interlocking portion, the second interlocking portion comprising the elongated insertable flange protruding between the front second edge section and the rear second edge section, and extending forwardly of the second retaining portion.

13. The modular surface covering asseembly of any claim 10, wherein the second edge region extends longitudinally along the panel and comprises a second abutting flange extending outwardly and rearwardly of the covering portion of the panel.

14. The modular surface covering assembly of claim 10, wherein the first panel edge engaging portion comprises the first interlocking portion including the elongated insertable flange extending inwardly and defining a hook opened longitudinally and inwardly, the first retaining portion being insertable into the hook and being translatable along the longitudinal axis when the panel is engaged with the plurality of panel supports.

15. The modular surface covering assembly of claim 14, wherein the first interlocking portion further comprises an outwardly extending tab extending away from the bearing surface when a respective one of the plurality of panel supports is mounted to the bearing surface and the first inwardly extending flange is superposed forwardly to the outwardly extending tab and defines the hook therewith and the hook comprises at least one retention protrusion protruding outwardly of the hook.

16. The modular surface covering assembly of claim 14, wherein the first retaining portion extends longitudinally along the panel and protrudes outwardly, the first retaining portion being inserted into the hook when the panel is engaged with a respective one of the plurality of panel supports.

17. The modular surface covering assembly of claim 14, wherein the second edge region comprises a front second edge section and a rear second edge section, and the second interlocking portion including the elongated receiving groove extending between the front second edge section and the rear second edge section, the elongated receiving groove extending inwardly and being opened outwardly, the elongated receiving groove being located forwardly from the second retaining portion and being engageable by the hook of a vertically adjacent one of the plurality of panel assemblies.

18. A panel assembly to cover a bearing surface, the panel assembly comprising:

a plurality of panel supports, each one of the panel supports comprising:

a mounting plate with a front face and a bearing surface abutting face, opposed to the front face;

a first panel edge engaging portion; and a second panel edge engaging portion; and a panel having a length extending along a longitudinal axis, a front face, a rear face, a first edge region with a first retaining portion extending longitudinally along the panel, a second edge region with a second retaining portion extending longitudinally along the panel, the second edge region being opposed to the first edge region, and a covering portion extending between the first edge region and the second edge region, the second edge region further comprising a second interlocking portion, the second interlocking portion being one of a male member protruding outwardly and a female member defined inwardly, the second interlocking portion being located forwardly of the second retaining portion;

the panel being engageable with the plurality of panel supports; when engaged together, the plurality of panel supports being spaced-apart from one another along the length of the panel, the rear face of the panel facing the front faces of the mounting plates, and the first and the second retaining portions being respectively engaged with the first and second panel edge engaging portions of the plurality of panel supports, one of the first panel edge engaging portion and the first edge region further comprising a first interlocking portion, the first interlocking portion being the other one of the male member and the female member, the first and second interlocking portions of adjacent panel assemblies being engageable into one another, the mounting plate extending outwardly past at least one of the first and second edge regions of the panel, and the panel being translatable with respect to the plurality of panel supports.

19. The panel assembly of claim 18, wherein the first edge region comprises a front first edge section, a rear first edge section and the first interlocking portion; the first interlocking portion comprising an elongated receiving groove defined between the front first edge section and the rear first edge section, the elongated receiving groove being located forwardly from the first retaining portion and the second edge region comprises a front second edge section, a rear second edge section, and the second interlocking portion, the second interlocking portion comprising an elongated insertable flange protruding between the front second edge section and the rear second edge section.

20. The panel assembly of claim 18, wherein the second retaining portion comprises a second abutting flange extending outwardly and rearwardly of the covering portion of the panel.

21. The panel assembly of claim 18, wherein the first panel edge engaging portion comprises the first interlocking portion including a first inwardly extending flange defining a hook opened longitudinally and inwardly, the first retaining portion being insertable into the hook and being translatable along the longitudinal axis when the panel is engaged with the plurality of panel supports.

22. The panel assembly of claim 21, wherein the first interlocking portion further comprises an outwardly extending tab extending away from the bearing surface when a respective one of the plurality of panel supports is mounted to the bearing surface and the first inwardly extending flange is superposed forwardly to the outwardly extending tab and defines the hook therewith and the hook comprises at least one retention protrusion protruding outwardly of the hook.

23. The panel assembly of claim 21, wherein the first retaining portion protrudes outwardly, the first retaining portion being inserted into the hook when the panel is engaged with a respective one of the plurality of panel supports.

24. The panel assembly of claim 21, wherein the second edge region comprises a front second edge section and a rear second edge section and the second interlocking portion comprises an elongated receiving groove extending between the front second edge section and the rear second edge section, the elongated receiving groove extending inwardly and being opened outwardly, the elongated receiving groove being located forwardly from the second retaining portion.

25. A method to cover a bearing surface with a plurality of the panel assembly as claimed in claim 18, the method comprising the steps of:

engaging each one of the panels with a respective one of the plurality of panel supports by engaging the first and second retaining portions of the panels respectively with the first and second panel edge engaging portions of the respective one of the plurality of panel supports, the respective one of the plurality of panel supports being configured in a spaced-apart configuration to obtain a plurality of assembled panel assemblies;

securing a first one of the assembled panel assemblies to the bearing surface;

positioning a second one of the assembled panel assemblies in an adjacent configuration by engaging one of the first and the second interlocking portions of the first one of the assembled panel assemblies with the other one of the first and the second interlocking portions of the second one of the assembled panel assemblies; and securing the second one of the assembled panel assemblies to the bearing surface.

* * * * *